US006311605B1

(12) United States Patent
Kellner et al.

(10) Patent No.: US 6,311,605 B1
(45) Date of Patent: Nov. 6, 2001

(54) ARRANGEMENT FOR PROTECTION AGAINST SHAPED CHANGES

(76) Inventors: Gerd Kellner, Dr.Helmut-Junghans-Strasse 49/1, D-78713, Schramberg; Christian Nentwig, Eisencher Str. 6, Koblenz, both of (DE)

( * ) Notice: Subject to any disclaimer, the term of this patent is extended or adjusted under 35 U.S.C. 154(b) by 0 days.

(21) Appl. No.: 09/197,029

(22) Filed: Nov. 20, 1998

(30) Foreign Application Priority Data

Jun. 5, 1998 (DE) ..... 198 25 260

(51) Int. Cl.[7] ..... F41H 5/02
(52) U.S. Cl. ..... 89/36.02
(58) Field of Search ..... 89/36.01, 36.02

(56) References Cited

U.S. PATENT DOCUMENTS 3,324,768 * 6/1967 Eichelberger ..... 89/36
3,684,631 * 8/1972 Dunbar ..... 161/37
3,826,172 * 7/1974 Dawson ..... 89/36
4,665,794 * 5/1987 Gerber et al. ..... 89/36.02
4,881,448 * 11/1989 Medin et al. ..... 89/36.02
5,616,885 * 4/1997 Walters et al. ..... 102/476
5,739,458 * 4/1998 Girard ..... 89/36.02

FOREIGN PATENT DOCUMENTS

2771490 * 8/1989 (FR) ..... F41H/5/007

* cited by examiner

*Primary Examiner*—Michael J. Carone
*Assistant Examiner*—Michelle Thomson
(74) *Attorney, Agent, or Firm*—Scully, Scott Murphy & Presser

(57) ABSTRACT

An arrangement for protection against shaped charges, primarily bomblets which approach or which position themselves on an object such as armored target object, through the provision of disruptive bodies on the target object.

49 Claims, 22 Drawing Sheets

ARRANGEMENT FOR PROTECTION AGAINST SHAPED CHANGES

The present invention relates to an arrangement for protection against shaped charges, primarily bomblets which approach or which position themselves on an object such as an armored target object.

The survivability of armored vehicles depends decisively upon their protective capability against threats which come from above or from the side. With regard to threats, which come from above, counted in the first instance are the so-called bomblets which are expelled from artillery grenades or warheads above the field of combat, and wherein the final path of flight is traversed in a free fall, mostly by means of being equipped with a simple aerodynamic stabilization. The arming is effected upon or subsequent to the explosion from the warhead through aerodynamic and mechanical aids. The triggering of the bomblets is mostly initiated through the rearward delay which is encountered upon striking against the surface of the target.

The actual active component of such charges consists of so-called hollow charges with a conical or trumpet-shaped insert, which can possess a uniform or variable wall thickness along its height, whereupon this is then, respectively, designated as a degressive or progressive hollow charge. In order that the hollow charges are able to unfold their full power, a high degree of manufacturing symmetry and corresponding dynamic material properties is a basic prerequisite.

From the practice it is known that already extremely small disturbances, caused through manufacturing imprecisions, inhomogeneities in the explosive, or slightly asymmetrically extending triggering cycles, or through a not completely regular through-detonation of the explosive, leads to such a significant reduction in power, that the hollow charge-jet or hollow barb which is formed from the insert will not spread or stretch, in a fully axially symmetrical manner.

In FIG. 1 there is schematically illustrated a shaped charge in the form of a bomblet 1 at the point in time of striking against the surface 10 of an object which is to be protected. The bomblet 1 consists essentially of a housing 2, which is filled with an explosive 3 in such a manner that this explosive 3 will surround a downwardly opening insert 4 which is constituted of a material, for example, such as copper. The explosive 3 which is through-detonated by means of a fuze 6 presses the insert together at a high rate of speed so that, from the tip region of the insert 4, there is formed a hollow charge-jet or a jet 5. The insert 4 is thus deformed by means of the detonation of the explosive 3 into the jet 5 which moves under a continual stretching effect towards the surface 10 and penetrates into the latter. The peak velocities of the particles which form the jet 5 lie hereby between 5 and 8 kilometers per second (km/sec), whereas the diameter of the formed jet 5 lies within the millimeter range. At a complete precision, in a homogeneous steel armor there are attained penetrating depths which lie between 4 to 8 times the largest insert diameter. The mechanical impact detonation is effected, as a rule, in that a detonating needle 7 due to its inertia, upon striking against the object moves in a passageway 8 towards the fuze 6, and pierces the latter, as a result of which there is detonated the bomblet 1. The fuze 6 thereby brings the explosive 3 to detonation.

The power capability of the bomblet 1 depends essentially upon the stretching or expansion of the jet 5. This is achieved in that the originally quasi-homogeneous jet at the point in time of its formation is stretched and thereby caused to be particularized. A depth effect is then obtained from the addition of the individual powers of the individual particles forming the jet 5, which must penetrate behind each other in an absolutely precise manner. The stretching of the jet 5 takes place continuously, whereby the distance between the particles from the tip in the direction of the bomblet 1 continually reduces. For a desired penetrating power it is necessary to provide a specific stretching path 9, which is generally designated as a stand-off. The stand-off 9 is formed by the distance of the lower conical boundary of the insert 4 to the surface 10.

For impact detonators which necessitate a sufficient delay for their operational activation, the stand-off 9 in comparison with the diameter of the insert 4 of the bomblet 1 is formed small due to constructional requirements (referring, for example, to FIG. 1). For warheads with proximity fuzes, or with electrical triggering the stand-off 9 can be formed correspondingly larger (approximately 2-times the diameter of the insert).

Over a long period of time until now there has not been available any effective capability for protection against shaped charges, such as bomblets which approach or position themselves on an object.

SUMMARY OF INVENTION

Accordingly, it is an object of the present invention to provide an arrangement affording protection against shaped charges, such as primarily bomblets.

The foregoing object is inventively attained through the intermediary of an arrangement in which the surface of the armoring of the object which is to be protected has disruptive bodies associated therewith, whose height, shape and arrangement are dimensioned such that at least one such body, for the disruption of the jet formation of the shaped charge, can penetrate into an internal region of a hollow charge insert or into the so-called stand-off region of the shaped charge.

The principle of the arrangement pursuant to the invention is predicated on that the formation of a symmetrical jet of a bomblet can be prevented, and thereby the power thereof is able to be quite significantly reduced. This is preferably implemented through the penetration of at least one disruptive body into the internal region of the hollow charge insert and/or into the region of the insert opening.

Through the introduction of the disruptive body into the internal region or at least into the lower central region of the shaped charge, the jet is disrupted already at the beginning of the stretching thereof and prior to the jet being fully formed in a particular advantageous manner, in that the final ballistic power capacity of the hollow charge is reduced up to a fraction of its maximum power capability. Comparable power reductions can be achieved with no other of the measures known from the standpoint of the target in the practice, and also not with the most modern dynamic methods.

BRIEF DESCRIPTION OF THE DRAWINGS

Exemplary embodiments of the invention are further elucidated hereinbelow with reference to the drawings; in which.

DETAILED DESCRIPTION OF PREFERRED EMBODIMENTS

Figure 2:
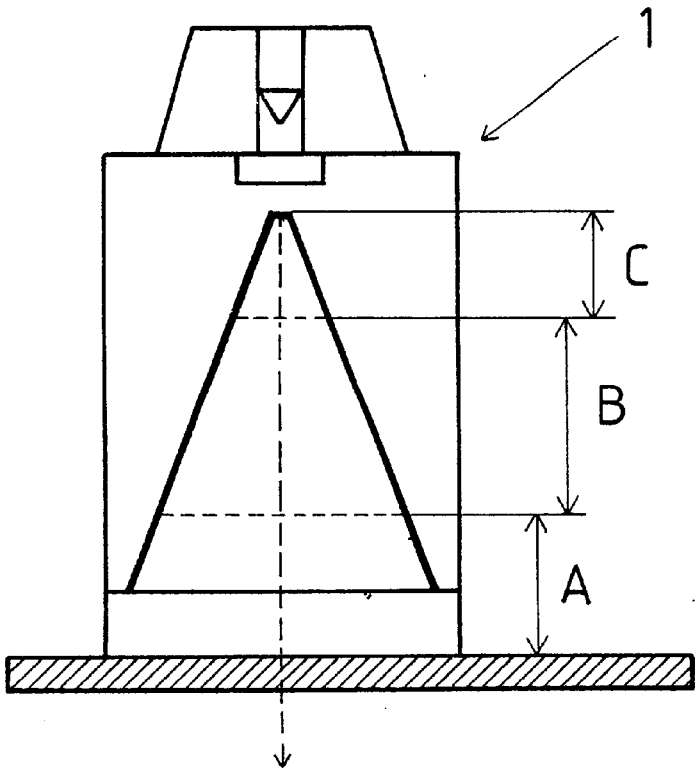
FIG. 2 illustrates the subdivisions of the different effective zones of that type of charge.

For an explanation of the individual modes of the effect and capabilities of the herein described arrangement,there is implemented a subdivision of the region of the insert 4 inclusive the stand-off 9 into three zones. In FIG. 2, these are designated with zone A for the lower conical region and the stand-off 9, zone B for the middle region of the insert 4, and zone C for the tip region of the insert 4, which is arranged on the side of the insert 4 facing towards the fuze 6.

Figure 3:
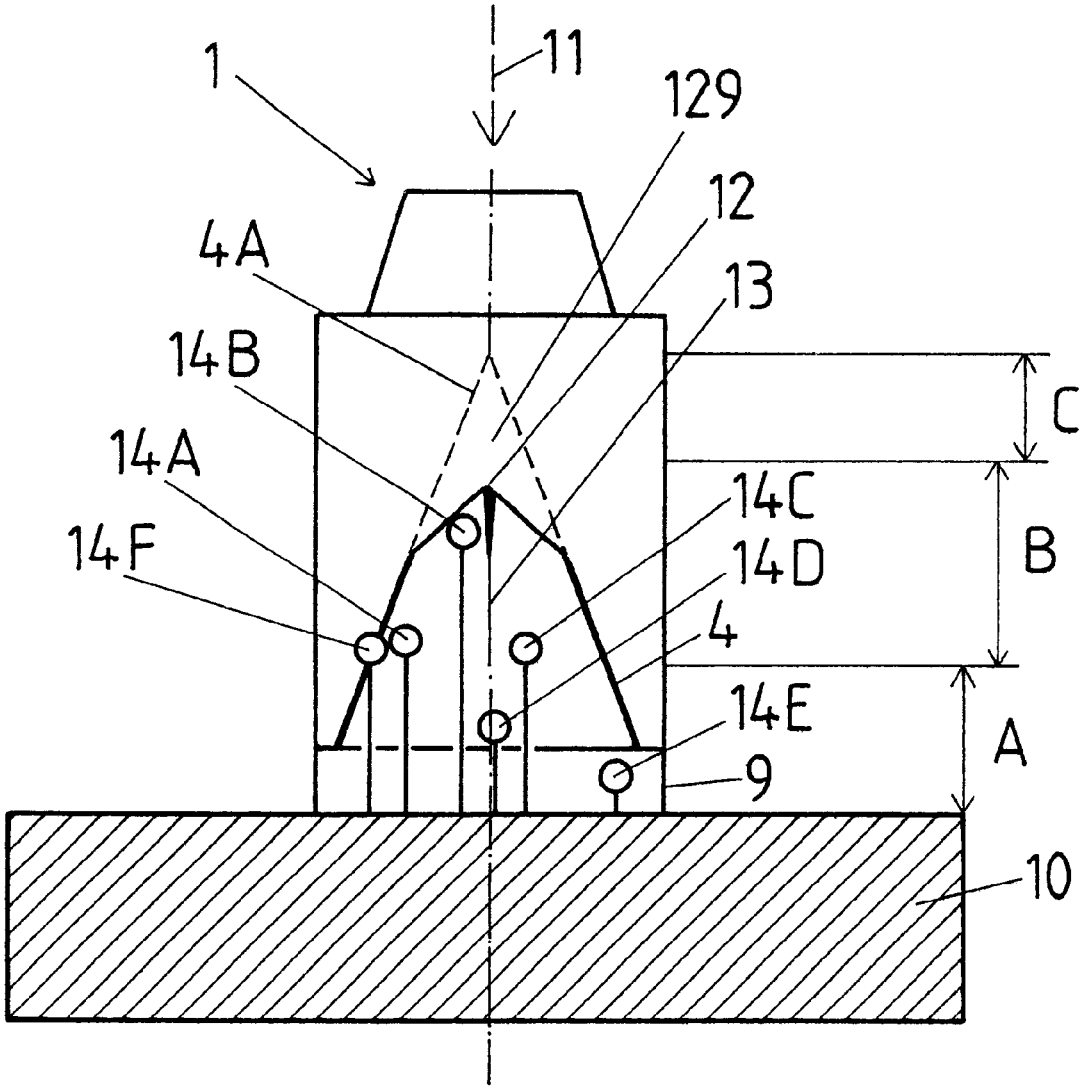
FIG. 3 illustrates different positions of disruptive bodies.

In FIG. 3 there is represented a bomblet 1 which is located on the surface of an armoring 10. Thereby, illustrated are a plurality of effective centers of gravity 14A, 14B, 14C, 14D, 14E, 14F of possible disruptive bodies in characteristics positions in an interior 129 of the insert 4. The effective centers of gravity of the disruptive masses or disruptive bodies are in the different geometrical embodiments of the disruptive bodies not identical with the actual centers of gravity of the masses. These designate primarily the location at which the disruptive body causes its greatest disruption of the jet. The connection between the effective centers of gravity 14A through 14F and the surface of the armoring 10 the object which is to be protected is effected either through a special arrangement, or presently through the disruptive bodies; for example, such as the disruptive bodies 16A through 16G, 17, 18 and 19 themselves. For assisting in the orientation, there is illustrated the direction of movement of the bomblet 1, its axis of symmetry 11, the collapsing point 12, and the forming jet tip 13. The already deformed portion of the insert 4 is designated with 4A.

The locations of the different effective centers of gravity 14A through 14F which are illustrated in FIG. 3 and thereby emphasized, the main disruptive center of gravity 14A is located at the inner wall of the cladding (insert) 4. In the location of the effective center of gravity 14B, the disruptive body projects until it reaches into the upper region of the insert 4, in the location of the center of gravity 14C in the middle region of the insert 4 outside of the axis of symmetry 11. Correspondingly, the disruptive body in the position 14D in the lower central region of the insert 4 is arranged proximate the axis of symmetry 11, and at the location of the center of gravity 14E, the disruptive body acts in the region of the stand-off. A special instance represented by the location of the effective center of gravity 14F. Here, the disruptive body mechanically pierces through or deforms the insert 4.

Figure 4:
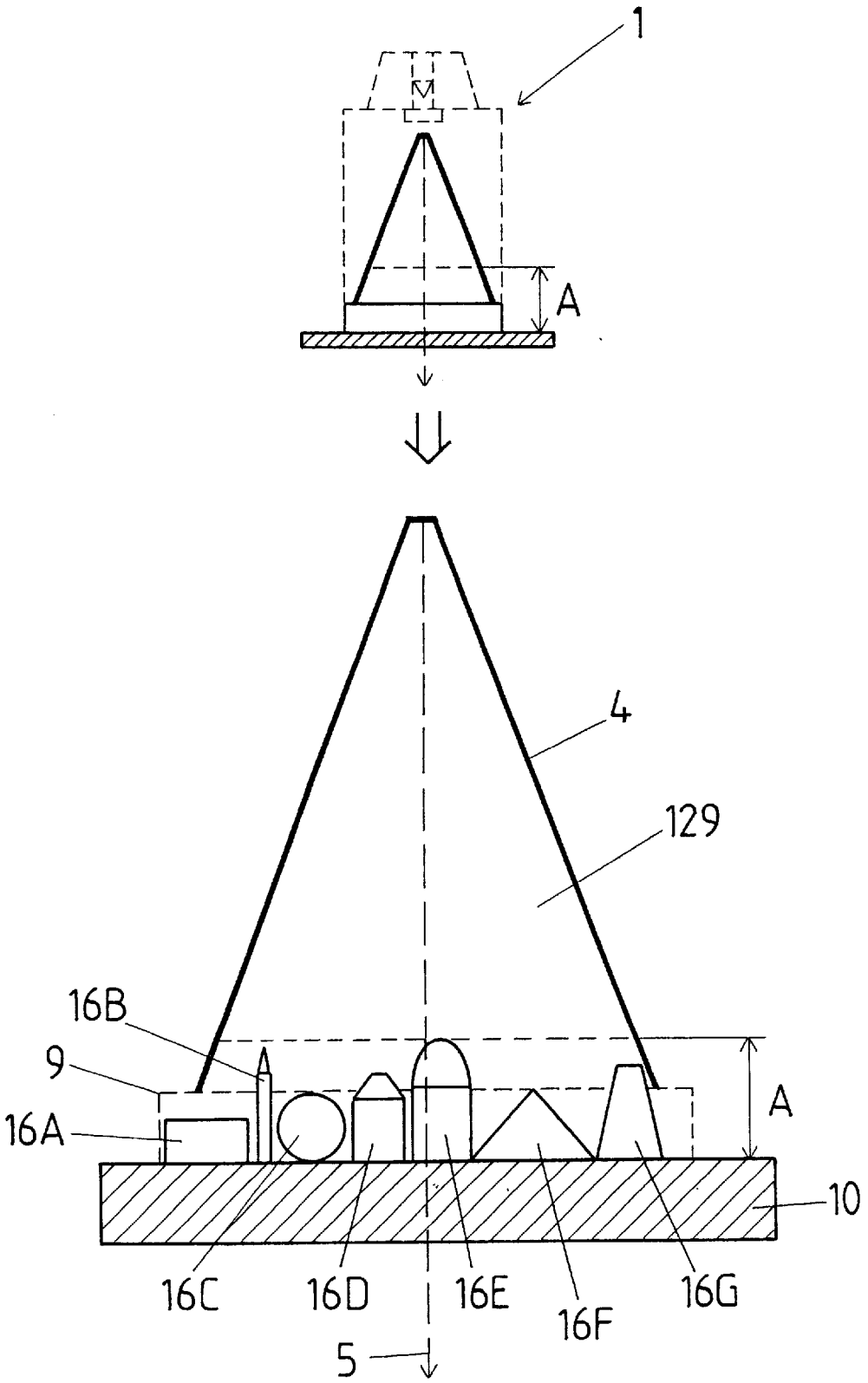
FIG. 4 illustrates a zone A with further differently configured disruptive bodies.

In FIG. 4 there is schematically illustrated the region of the insert 4 of the bomblet 1, as well as the zone A, and as well as; for example, disruptive bodies 16A, 16B, 16C, 16D, 16E, 16F, 16G. Hereby the disruptive bodies 16A through 16G are formed as different geometric bodies. Individually, the disruptive body 16A cylindrical, the disruptive body 16B rod-shaped, the disruptive body 16C spherically shaped, the disruptive body 16D cylindrical with a frusto-conical tip, the disruptive body 16E cylindrical with a rounded-off tip, the disruptive body 16F as a sharp tipped cone, and the disruptive body 16G as a truncated cone. All of the illustrated rotationally disruptive bodies can also be constructed cornered or symmetrical multi-sided; for example, as quadrats truncated pyramids, in the event that these due to reasons of signature conditions (radar detection) are considered as being advantageous. It lies within the scope of one skilled in the art that the embodiments illustrated in FIG. 4 for a disruptive body can also be employed for the desired effective centeis of gravity 14D and 14E of the disruptive bodies which are schematically illustrated in FIG. 3.

Figure 5:
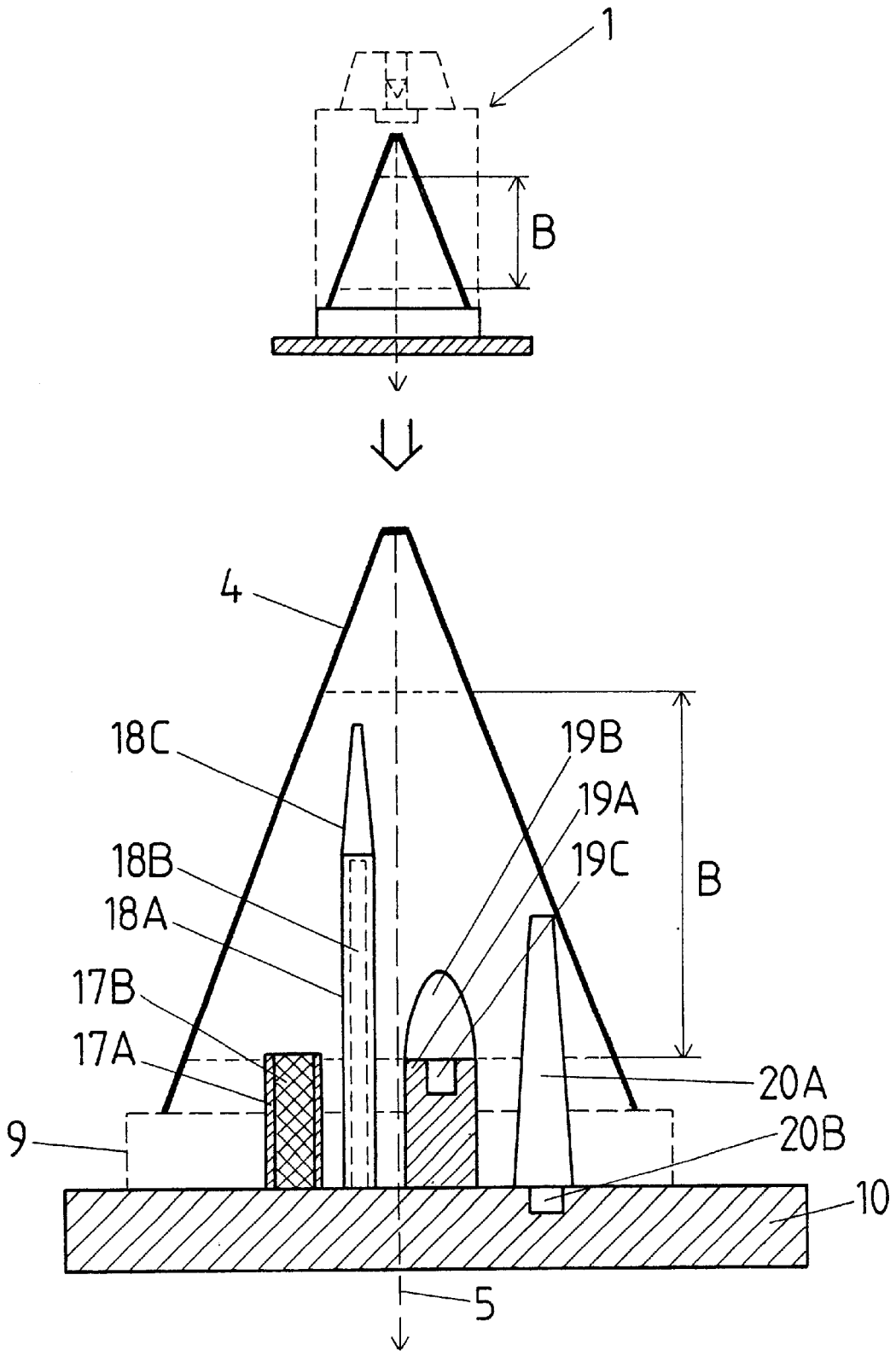
FIG. 5 illustrates a zone B with further examples of differently configured disruptive bodies.

FIG. 5 illustrates a few embodiments of disruptive bodies, which evidence a such a length that these project into the zone B of the insert 4. Hereby, a disruptive body 17A is constructed as a hollow cylinder, which in the present examplary embodiment is filled with a medium 17B. The disruptive body 17A can also be simply constructed as a hollow body without any filler medium. The disruptive body 18A is constructed rod-shaped and can similarly possess hollow space 18B and/or also a tip 18C.

The disruptive body 18A, pursuant to a further embodiment which deviates from the foregoing exemplary embodiment, can be constructed solid and without a tip.

A disruptive body 19A which is illustrated in FIG. 5 is cylindrical and formed with a rounded-off tip 19B, whereby the basic cylindrical body is connected by means of a trunnion 19C with a rounded-off tip 19B. A disruptive body 20A is configured as a truncated cone which; for example, by means of a trunnion 20B is fastened in the surface of the armoring 10 of the object to be protected as a carrying or support structure.

The disruptive body 17A represents a specialized embodiment of the effective centers of gravity 14C and 14D illustrated in FIG. 3. The same as applicable to the disruptive body 18A which represents a specialized form of the effective centers of gravity 14B and 14C pursuant to FIG. 3. The disruptive body 19A represents a specialized exemplary embodiment of the effective center of gravity 14E pursuant to FIG. 3, and the disruptive body 28A for the effective center of gravity 14A pursuant to FIG. 3. Naturally, the transitions between between the individually represented embodiments of the disruptive bodies is variable, and can be contemplated by a multiplicity of combinations thereof.

Figure 6:
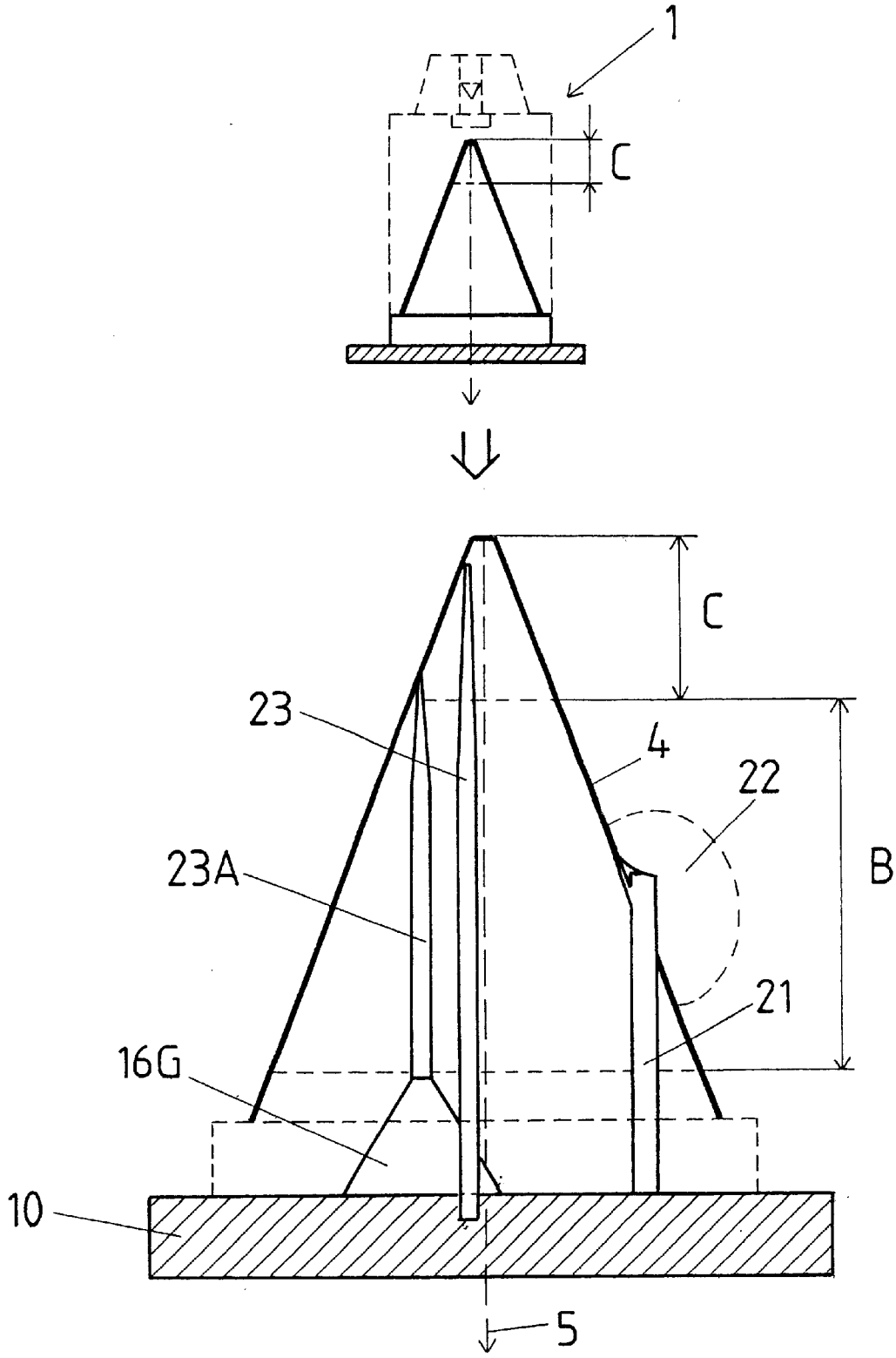
FIG. 6 illustrates the zones B and C with further examples of differently configured disruptive bodies.

In FIG. 6 there is illustrated the zone C of the insert 4, whereby rod-shaped disruptive body 23 is constructed in such a manner that it penetrates into the zone C, and in its principle embodiment corresponds to the effective center of gravity 14B of FIG. 3. Moreover, the combination of a rod-shaped disruptive body 23 with a conically constructed basic disruptive body 23B is illustrated by way of example. This combination concurrently causes disruptions of the jet 5 in the zones A, B & C, as is schematically represented in FIG. 3 by means of effective centers of gravity 14B, 14D and 14E. A particularly interesting instance of disruption is illustrated in FIG. 6. This disruptive body 21, which in this exemplary embodiment is formed as a cylindrical disruptive body, penetrates the insert 4 of the bomblet 1 which strikes against the surface of the armoring 10. As a result thereof, there is produced a greater deformed or disrupted zone 22, which upon the through detonation of the explosive 3 leads to particularly outstanding disruptions of the jet 5.

At this juncture it should be pointed out that the representative examples for disruptive bodies cause not only the jet disruptions with regard to their effective centers of gravity, but also that the connections to the surface of the armoring 10, such as connectors, casings, and so forth, cause further timely disruptions which extend over a greater spatial region.

Figure 7C:
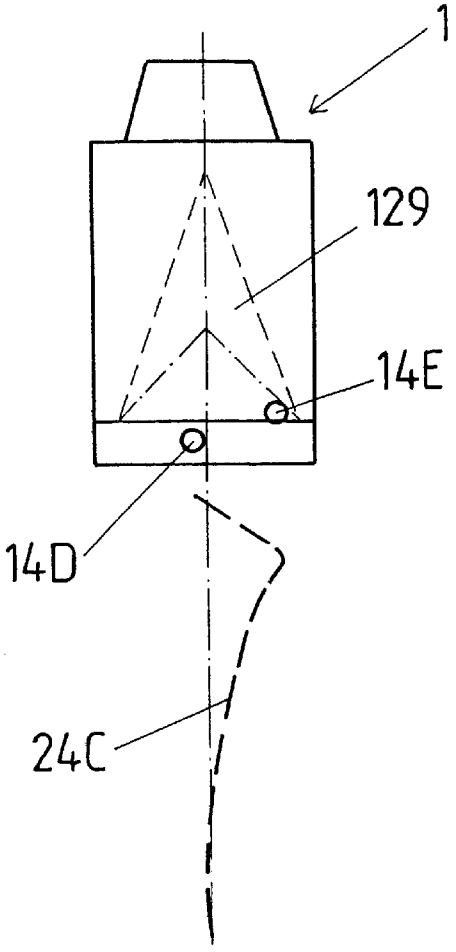
FIGS. 7*a* through 7*c* illustrate schematic representations of the deviation of the jet from its ideal line in dependence upon the position of the disruptive body which is introduced into the insert.
Figure 7B:
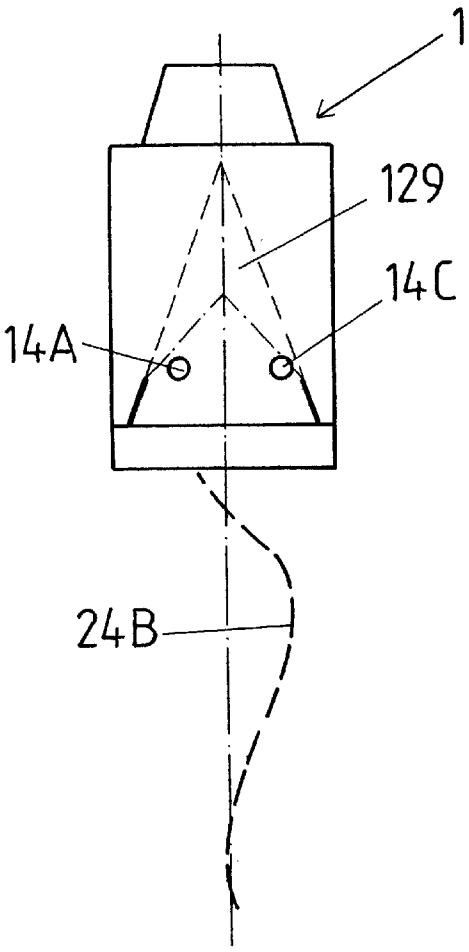
Figure 7A:
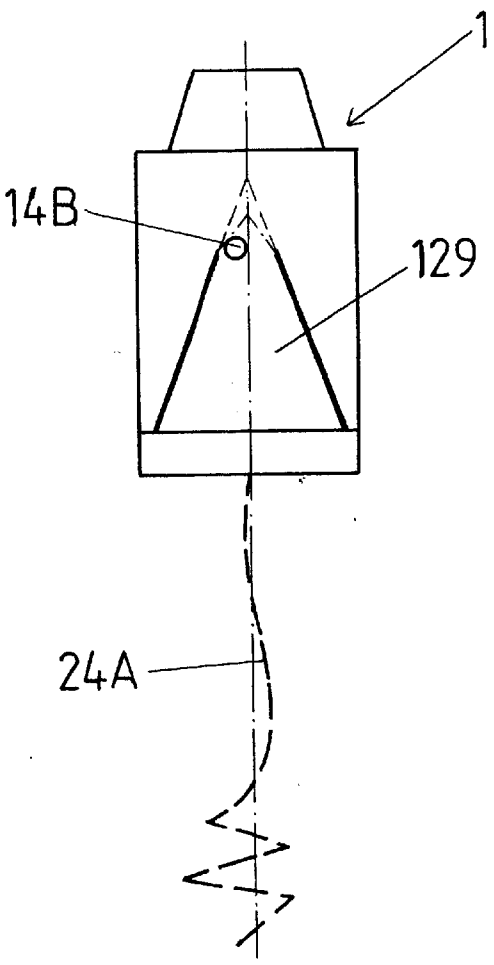

FIGS. 7*a* through 7*c* illustrate three examples of typical jet disruptions corresponding to the positions of the effective centers of gravity 14A, 14B, 14C, 14D, and 14E. The jet disruption illustrated in FIG. 7*a*, which is represented by the phantom line 24A is initiated by the position of the effective center of gravity 14B. Thereby, the effective center of gravity 14B of the disruptive body is presented in a considerably schematic manner as a black circle, which represents the interior region 129 of the insert 4 which is reached by the end of the disruptive body.

Inasmuch as the lower rapid portion of the jet which provides for the highest power component during the penetration of the armoring of the object which is to be protected, is formed by the tip of the insert 4, in this part, meaning within the zone C the disruption by means of a disruptive body is at its most intense. In addition, to the already mentioned disruption through the connections of the disruptive bodies and of the armoring 10, due to shock-wave reflections in the explosive and in the region of the insert 4, the introduced disruption also propagate into the following regions, so that the disruption of the jet does not remain restricted to only this region. This consideration, for the remainder is applicable to all further illustrated and described examples.

The jet disruption illustrated in FIG. 7*b*, which is graphically represented by the phantom-line 24B, is caused through the disruptive bodies with the effective centers of gravity 14A and 14C which are brought into the interior region 129 of the insert 4. There is achieved a further deflection of the middle portion of the jet 5.

The jet deflection illustrated in FIG. 7*c*, pursuant to a phantom-line 24C is caused by the entry of the disruptive bodies with the effective centers of gravity 14D, 14E into the interior region 129 of the insert 4. The disruptions in the formation of the jet 5 here remains concentrated primarily on the rearward portion of the jet, whereas the disruptive body with the effective center of gravity 14D due to its symmetrical axis-proximate position causes awaiting still further disruptions in the forward portions of the jet. Understandably, from the most different combinations of the locations of the center of gravity, as well as the embodiment of the outer form, and as well as the jet disruption corresponding to the length of the disruptive bodies, which as a rule add to each other since they basically support the asymmetry.

In the event that robust or relatively simply structured surfaces are to be implemented, one can be employ short, thick disruptive bodies with effect in the region of zone A. By means of these, for example, there can be realized accessible surfaces. Such measures correspond to the example illustrated in FIG. 7*c*, whereby the effect combines itself from a number of factors, when concurrently a plurality of disruptive bodies can be placed in the interior region of a striking bomblet 1, or when a central disruptive body leads to a concurrent asymmetrical disruption of the stretching hollow charge jet.

Figure 8:
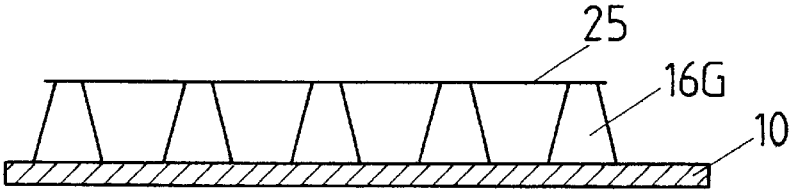
FIG. 8 illustrates a plurality of disruptive bodies which are provided with a covering.

Should there be realized flat surfaces of the object which is to be protected, then, for example, as illustrated in FIG. 8 and as truncated cone configured dissruptive bodies 16F can be contemplated with a covering 25. Then, there is merely to be considered that this covering 25 does not prevent the further sinking down of the charge up to its detonation, in effect, the covering should not be constructed two massively. Just as well, it is possible to configure the covering 25 to be removable, so that it is first removed in a serious instance. Such types of coverings are then of particular interest when there is desired a specified signature behavior of the surfaces. It is also possible through specific forms and materials to impart to the disruptive body-supporting surface an advantageous signature phenomenon.

Figure 1:
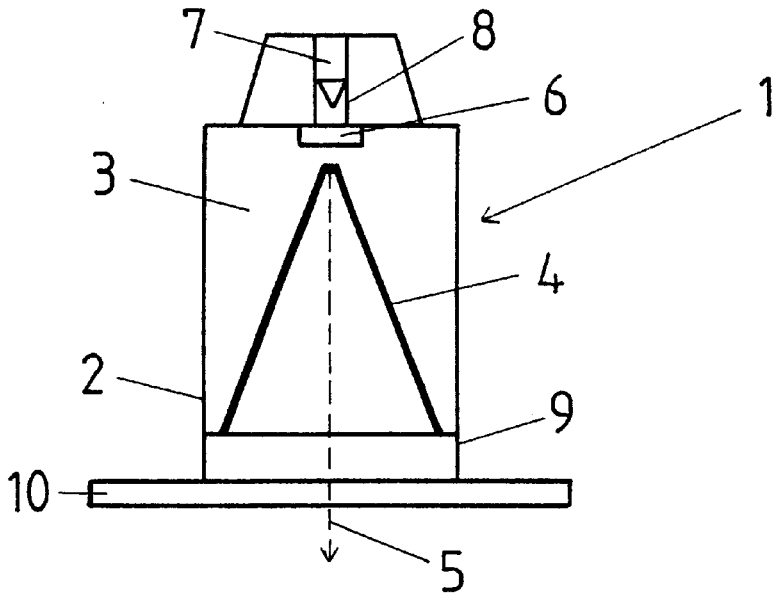
FIG. 1 illustrates components of a shaped charge in the form of a bomblet for attacking from above an object which is to be protected.
Figure 9A:
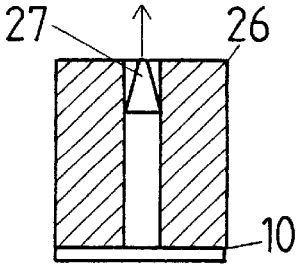
FIGS. 9*a* and 9*b* illustrate depressed or, respectively, partially outwardly extended disruptive body.
Figure 9B:
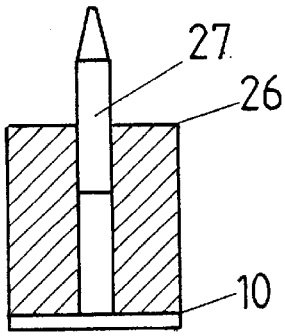

In FIG. 9*a*, 9*b* and 1O*a*, 10*b* there are dynamically built up disruptive zones in accordance with need. Thus, in the example illustrated in FIGS. 9*a*, 9*b*, the disruptive bodies 27 are outwardly extended or justified from the surface 26 of a suitably constructed target. Thereby, in FIG. 9*a* the disruptive body is illustrated in the retracted position and in FIG. 9*b* in a partly outwardly extended position.

Figure 10A:
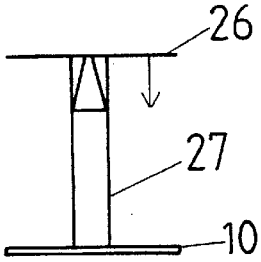
FIGS. 10*a* and 10*b* illustrate, respectively, the release of disruptive bodies through the deflecting back of a surface.
Figure 10B:
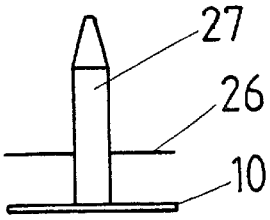

FIGS. 10*a* and 10*b* illustrate an alternative embodiment in comparison with FIGS. 9*a* and 9*b*, whereby a surface 26 which originally covers the disruptive body 27 deflects back into the illustrated direction of the arrow (FIG. 10*a*) and thereby releases the disruptive body 27 (FIG. 10*b*).

Figure 11A:
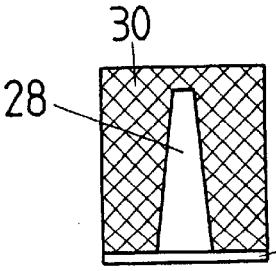
FIGS. 11*a* through 11*d* illustrate examples for a disruptive body which is embedded in a matrix or, respectively, a matrix which is equipped with disruptive bodies.
Figure 11B:
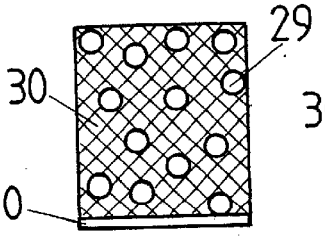
Figure 11C:
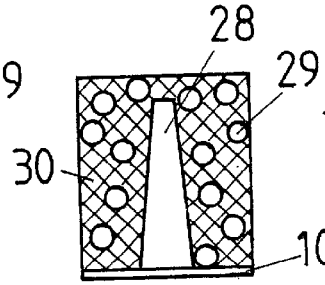
Figure 11D:
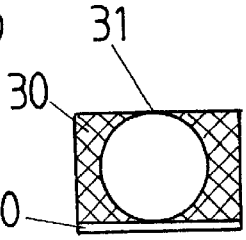

In FIGS. 11*a* to 11*b* there are illustrated a few special embodiments of target with the above-mentioned protective properties, whereby on the surface of the armoring (remaining or follow-up armoring) 10 of the object which is protected, there are applied disruptive bodies which cause the desired disruption of the jet. Thus, FIGS. 11*a* through 11*b* illustrate examples of disruptive bodies which are embedded in a relatively soft, yieldable matrix 30. In FIG. 11*a*, for example, there is positioned in a defined manner a conical disruptive body 28 in that type of material. In FIG. 11*b*, spherically-shaped disruptive bodies 29 are emerged in a regular or irregular distribution within the matrix 30. In FIG. 11*c*, there is represented a combination of the embodiments of the disruptive bodies 28 and 29 as illustrated in FIGS. 11*a* and 11*b*. In FIG. 11*d*, the matrix 30 is constructed as a positioning or embedding layer for a spherical disruptive body 31 which is not completely encompassed by the matrix 30. That type of matrix 30 can; for example, be constituted foamed of a material or a deformable polymeric material.

Figure 12A:
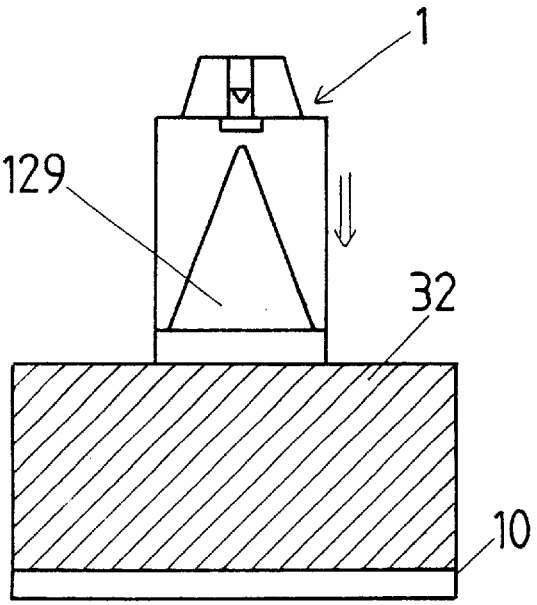
FIGS. 12*a* and 12*b* illustrate the penetration of a target material located on the surface of the object which is to protected in the interior region of a shaped charge.
Figure 12B:
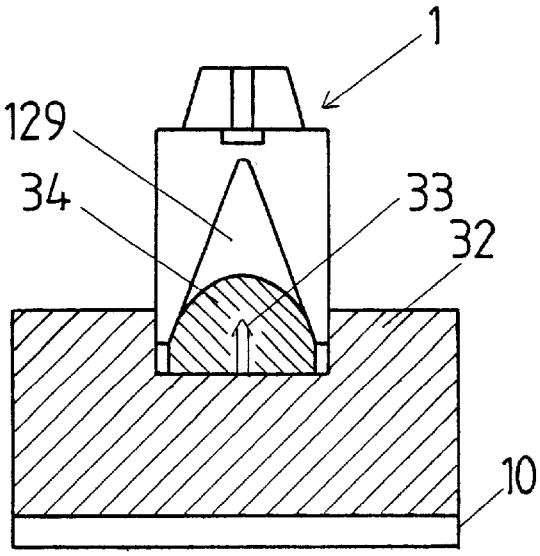

In FIG. 12, a layer 32 which is positioned in front of the surface 10 of the object which is to be protected, consists of a material which is constructed sufficiently yieldable so that during the penetration of the bomblet 1 it is accelerated into this layer 32 in a direction of the insert 4, as is illustrated by an arrow 33. Thereby, introduced into the interior region 29 of the insert 4 is a disruptive body 34 consisting of the material of the layer 32 for causing the disruption of the jet formation.

Figure 13A:
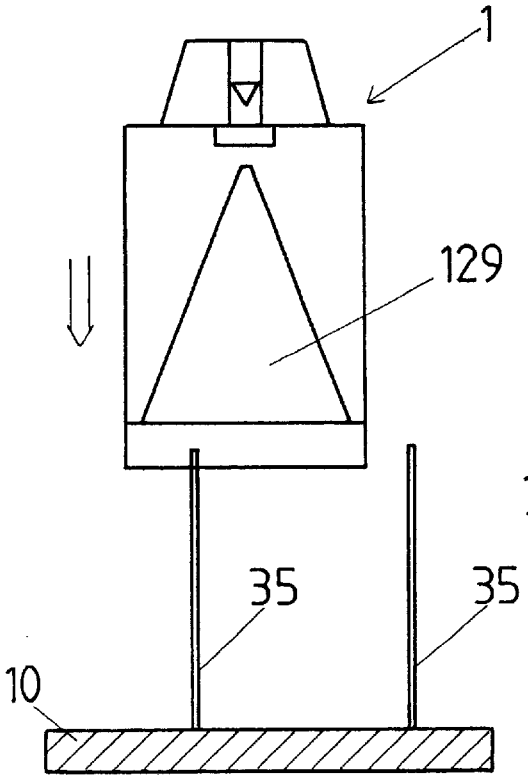
FIGS. 13*a* and 13*b* illustrate movable slender disruptive bodies.
Figure 13B:
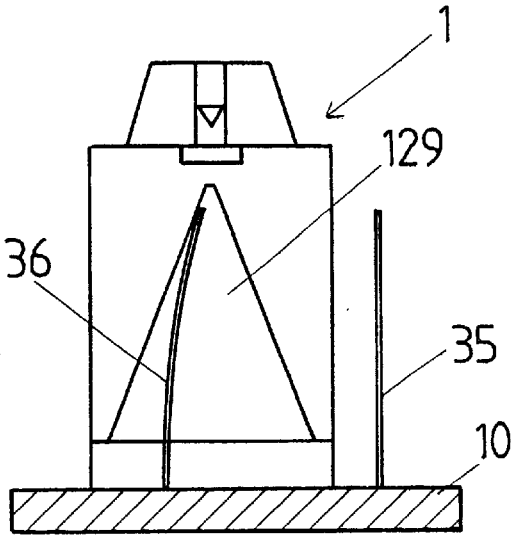

As already indicated, disruptions in the region of zone C, in effect in the tip region of the insert 4 are basically especially effective. In order to reach the zone C during the striking of the bomblet 1, there are expediently employed slender disruptive bodies, such as are illustrated, for example, in FIG. 6. In FIGS. 13*a* and 13*b* there are illustrated examples of such disruptive bodies 35. The object which is to be protected in FIG. 13*a* at the surface of the armoring 10, which is equipped with the disruptive bodies 35, the approaching bomblet 1 slides one (as illustrated) or a plurality (not illustrated) of the disruptive bodies 35, in dependence upon the distribution density, into the interior region 129 of the insert 4, and bends the disruptive body 35 into a shape which shown in FIG. 13*b* as represented by 36.

Figure 14A:
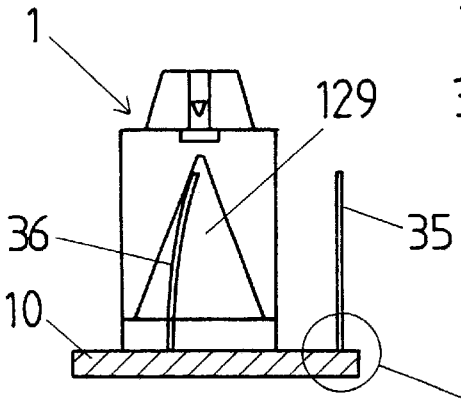
FIGS. 14*a* through 14*c* illustrate a schematically represented anchoring of different movable slender disruptive bodies.
Figure 14B:
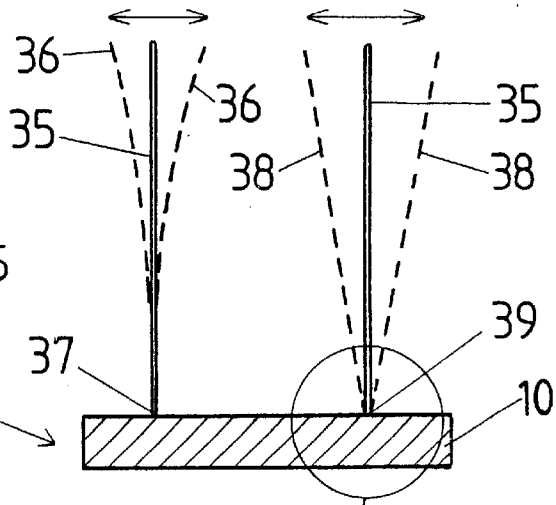
Figure 14C:
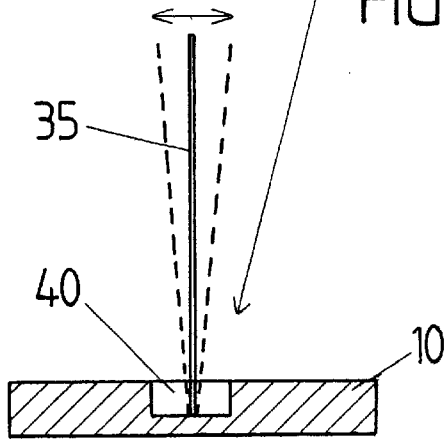

In FIGS. 14*a* and 14*b* there are illustrated two further examples of the manner in which by means of slender disruptive bodies 35 there can be reached the tip region of the insert 4 of a striking bomblet 1. The condition illustrated in FIG. 14*a* corresponds to the example illustrated in FIG. 13*b*. The disruptive body 35 is constructed to be bendable so that it can be brought into the shape illustrated by 36. Pursuant to FIG. 14*b* the disruptive body 35, as illustrated at 37, fixedly mounted in the surface of the armoring 10. Alternatively, to the bendable embodiment of the disruptive body 35, the disruptive body 35 can be rigidly constructed and by means of a turning device 39 moveably supported in the surface of the armoring 10 and bringable into the outwardly extended positions 38. The turning device 39, by way of example illustrated in FIG. 14*c*, can be; for instance, can be constituted of a housing 40 which is filled with an elastomeric material, which is embedded in the surface of the armoring 10.

Figure 15A:
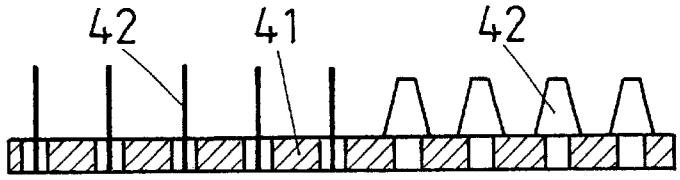
FIGS. 15*a* through 15*b* illustrate an apertured plate which is equipped with disruptive bodies, as well as a apertured plate which is correlated with an armoring and fastened thereto.
Figure 15B:
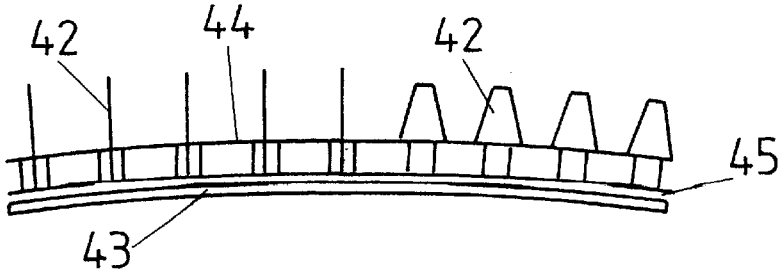

Basically, the layer carrying the disruptive bodies can be modularly assembled. It can also be advantageous to cover curved surfaces with such kinds of disruptive layers. FIG. 15*a* discloses, by way of example, an apertured plate 41 in which there are fastened disruptive bodies 42. In this case, there are represented two basic disruptive body shapes, firstly, a slender embodiment pursuant to the disruptive body 16B of FIG. 4, or the disruptive body 18A according to FIG. 5, and a conical configuration according to the disruptive body 16F or 16G as in FIG. 4. In FIG. 15*b* a support layer 44 consists of a hollow structure which carries the disruptive bodies 42. This structure, following the curvature of the supportive armoring 43, is connected by means of a fastening element (not shown) or a schematically represented fastening layer 45 with the supportive armoring 43.

Pursuant to a particular embodiment, a protective surface of that type can also be constituted of apertured sheetmetal strips with one or more rows of disruptive bodies.

Figure 16:
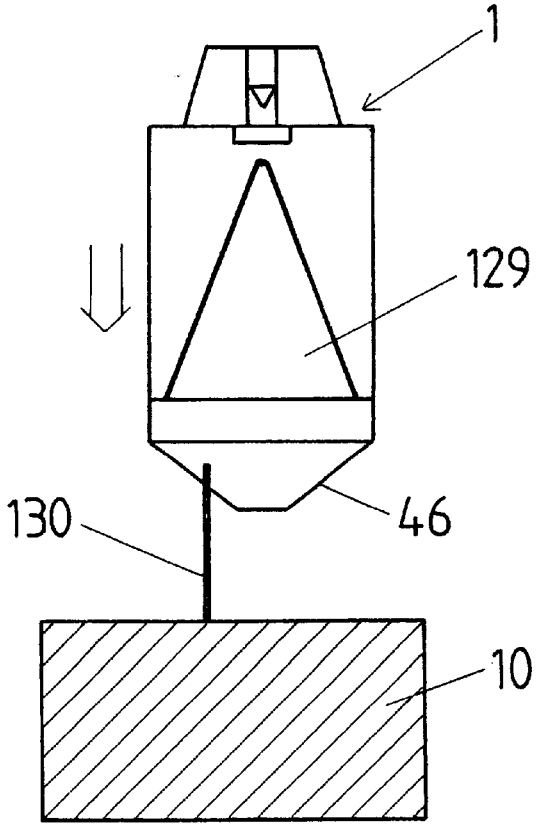
FIGS. 16 illustrates a schematic representation wherein a disruptive body penetrates a casing protecting the insert.

Inasmuch as it is also possible to contemplate that the insert 4 of a striking bomblet 1 is equipped with a covering 46, it is throughout possible that by means of a correspondingly constructed disruptive body 130, which in principle corresponds with the disruptive body 21 as in FIG. 6, to push through the covering 46 and to penetrate into the interior region 129 of the insert 4. This is illustrated in principle in FIG. 16 of the drawings.

Figure 17:
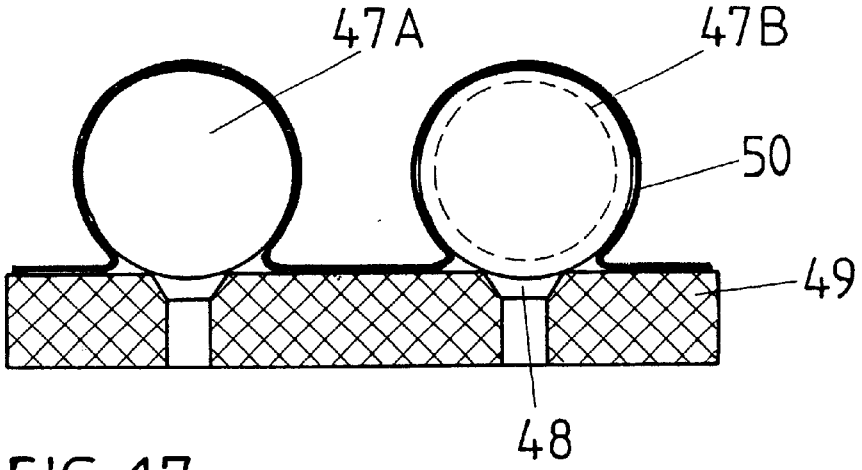
FIG. 17 illustrates disruptive bodies which are fastened by means of a foil.

A particular configuration of a disruptive layer built by a plurality of disruptive bodies 47A, 47B is illustrated in FIG. 17. Hereby, the disruptive bodies 47A, 47B are fixed on a support plate 49 by means of bores 48, and encompassed by a casing layer 50 which, for example, is applied under the effect subatmospheric pressure, such as would be a deep-drawn foil, onto the disruptive bodies 47A, 47B.

Figure 18A:
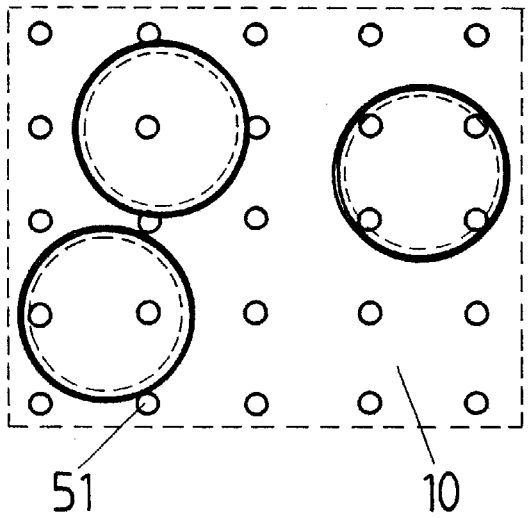
FIGS. 18*a* and 18*b* illustrate a schematic representation of grid-like coverings from above of the surface of the object which is to be protected.
Figure 18B:
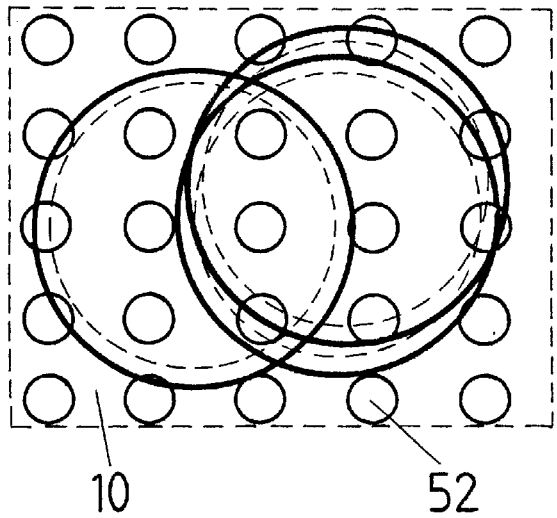

FIGS. 18*a* and 18*b* illustrate, respectively, a covering of the surface of the armoring 10 with disruptive bodies 51 and 52, whereby these are arranged in such as manner that one or more of the disruptive bodies 51, 52 can simultaneously penetrate into the interior region of a bomblet, which is schematically indicated by means of the circles.

Figure 19:
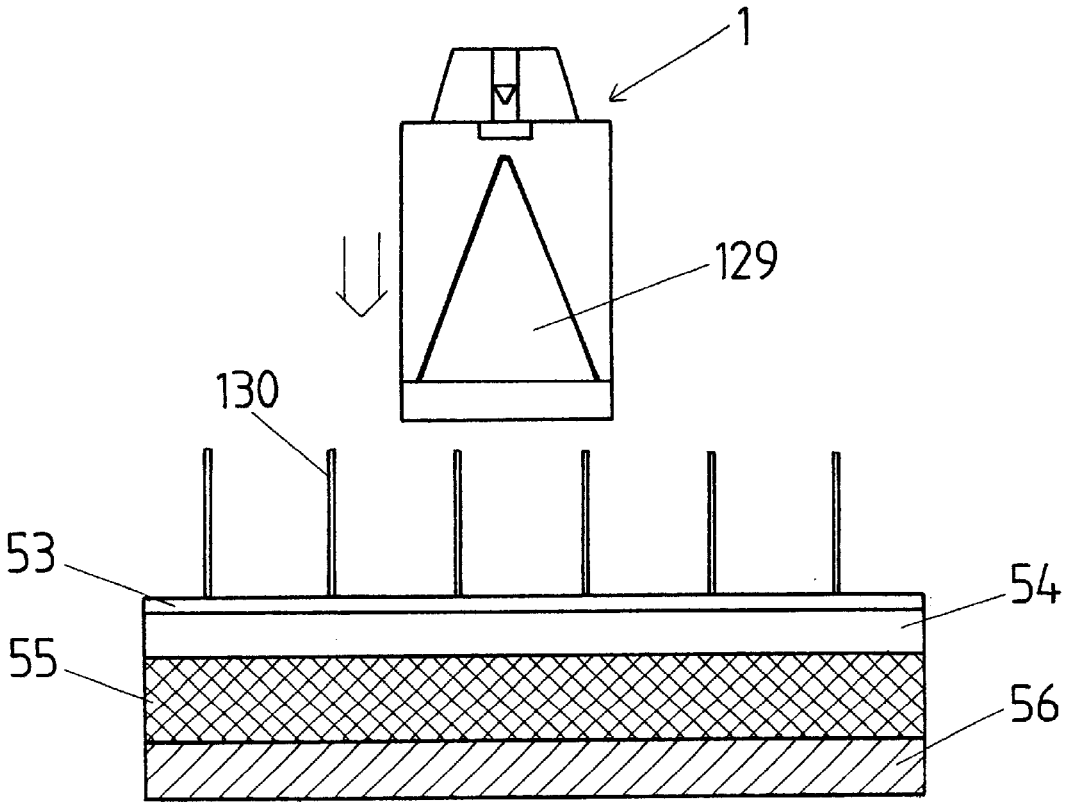
FIG. 19 illustrates an optimized armoring which connects itself to the disruptive bodies.

FIG. 19 illustrates an example for an expedient substructure below a layer with disruptive bodies. An exactly oriented high-powdered jet is essentially easier to disrupt by means of dynamically especially effective devices such as bulging structures then would be an already intensively dispersed jet. It is accordingly sensible that the jet which has been disrupted in a preceding zone 53, can be caught in a ballistically especially effective back-up armoring 54, such as is formed generally of a high-strength steel or ceramic. A back-up armoring or layer 54 can then, for example, be fastened on a supportive armoring 56 by means of a damping layer 55 which is also adapted for the further dispersion of residual jet portions still exiting behind the layer 54.

Figure 20C:
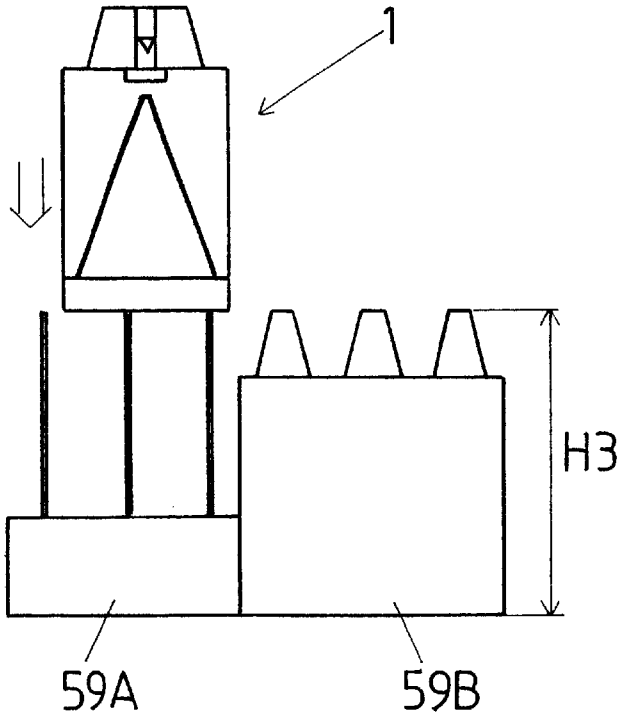
FIGS. 20*a* through 20*c* illustrate a comparison of different protective principles.
Figure 20B:
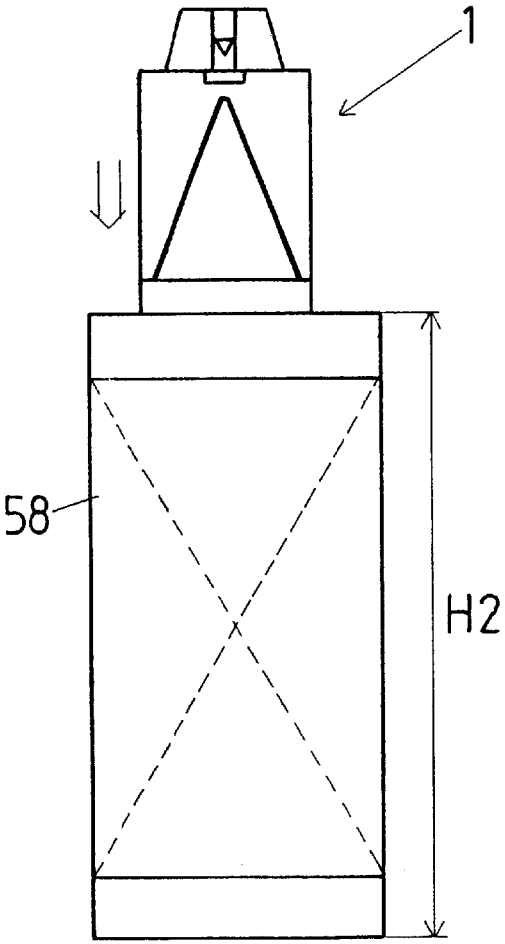
Figure 20A:
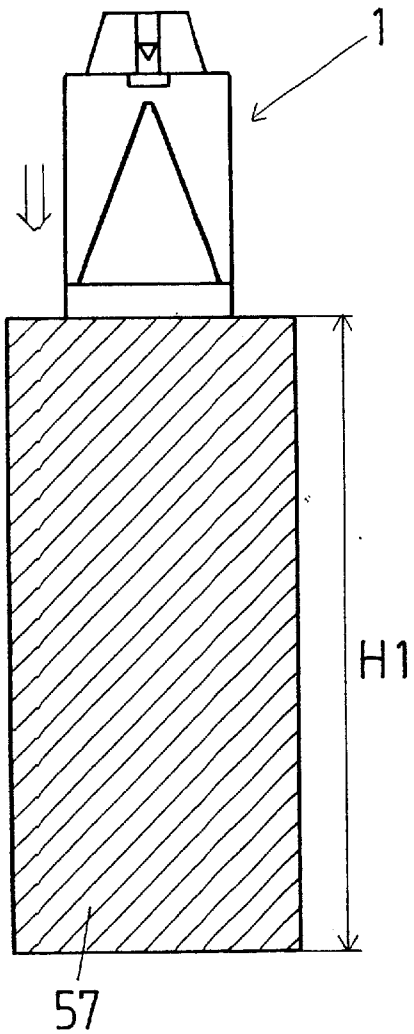

In FIGS. 20*a* through 20*c* there are comparatively represented three target constructions. Thus, FIG. 20*a* illustrates a homogeneous steel armoring 57 which is still to be penetrated by the bomblet 1 (limit of penetration). The reference mass in a reference height H1 here consists of presently 100%, which corresponds to the value 1.

In FIG. 20*b* the same bomblet 1 penetrates still further through a high-strength special armoring 58 of usual structure. The height H2 thereof corresponds with somewhat the height of the solid armoring 57, whereby its mass consists of only one-third that of armoring 58. In FIG. 20*c* there are represented two protectively equal armor structures with disruptive bodies 59A and 59B. Their total height H3 should be one-half the height H1 of the homogeneous armoring. At an assumed ratio of disruptive range height to back-up armoring of 1:4 for the right-hand example (relative solid disruptive bodies), there is obtained in the center a one-quarter of the mass of the homogeneous steel target. In the left-hand example, there are employed slender, thin disruptive bodies, which allow for a ratio between the disruptive range height and back-up armoring of 2:1. Thereby, the mass reduces itself to one-sixth the mass of the homogeneous steel target.

In an unusual manner the power capability of a protective arrangement is given by means of the product from mass efficiency, which corresponds with the ratio of the penetrated target mass of a steel armoring in limiting penetration to the penetrated target mass of the considered target, and the spatial efficiency which, in turn, again correspond to the ratio of the thickness of the steel armoring which is penetrated in the limiting penetration, relative to the thickness of the intended target. The example illustrated in FIG. 20*a* provides as a reference a product of 1, whereby contrastingly the special armoring 58 pursuant to FIG. 20*b* produces a product of three, and the structure pursuant to FIG. 20*c* which is equipped with disruptive bodies produces a product of eight for the right-hand example and of 12 for the left-hand example. That type of total effectiveness is not achieved or even approached by any of the other inert armoring which is known from the state of the technology.

The above comparative observation leads then to further significantly higher value numbers when the disruptive structure operates with slender disruptive bodies extending far into the insert 4, or when the disruptive bodies are set further apart and/or possess a lower mass. Since the disruption of the jet can be attained in accordance with the position of the disruptive body with practically every material, it is possible to achieve a multiplicity of extremely mass-efficient solutions.

Experimental studies which have been carried out in the interim, lead to the conclusion that highly effective disruptions can also be achieved when the mass centers of gravity of the disruptive bodies are located approximately between the upper third and the middle of the insert 4. This simplifies the construction of optimally acting structure with disruptive bodies.

Figure 21:
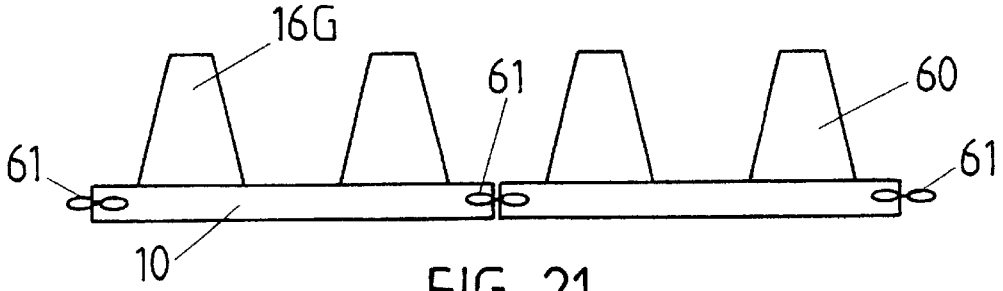
FIG. 21 illustrates a protective module carrying disruptive bodies with connecting elements.

It can often be expedient to modularly build up a protective structure of the proposed type. An example of that type is represented in FIG. 21. On the left-hand side, disruptive bodies 16G are mounted on a surface of the armoring 10 of the object which is to be protected. On the right-hand side there should be integrelly constructed disruptive bodies 60 with the surface of the armoring 10 of the object which is to be protected. The individual modules which form the protective surface are connected through connecting elements 61, which also allow for a certain movability of the thus produced connections.

Figure 22:
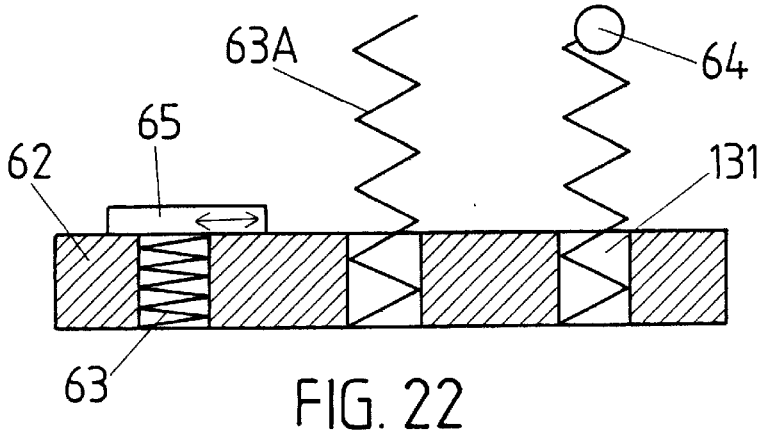
FIG. 22 illustrates a protective module with movable coverings and resiliently formed disruptive bodies.

A particularly advantageous technological solution of the herein proposed principle represents due to their in height variable disruptive bodies, such as; for example, those represented in FIG. 22. In a correspondingly configured support element 62, there are located spring-like disruptive bodies 63 which are retained in a chamber 131, by means of a moveable covering 65. When the coverings 65 are removed from the chamber 131, the disruptive bodies 63 are unstressed and then allow to expand. Thus, in FIG. 22 there is illustrated an unstressed disruptive body 63A. In order to provide an efficient disruption of the jet by an expedient effective center of gravity, the disruptive body 63 or 63A can be equipped with an additional disruptive mass 64 which is arranged at its end distant from the support elements 62.

This principle of a highly changeable disruptive body can be implemented in different manners. Thus, it is also possible to contemplate rubber-like disruptive bodies which can be folded bellows-like. Also, metal springs fulfill this task. The variation in the height can also be achieved by a laying down of resilient disruptive bodies, which can be resiliently uprighted when needed.

Figure 23A:
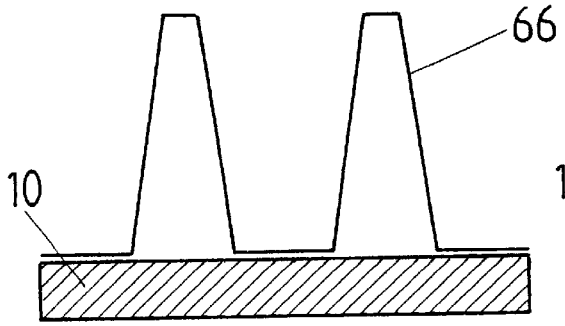
FIGS. 23*a* and 23*b* illustrate a thin surface structure with jet-disruptive properties.
Figure 23B:
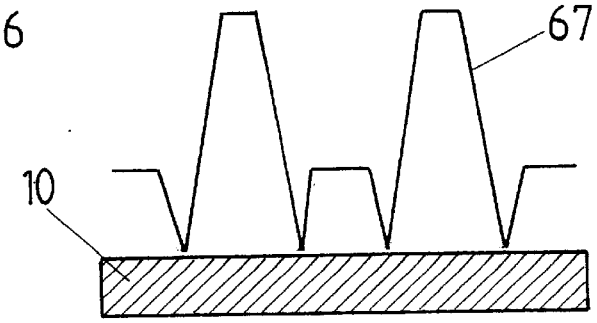

Two further technologically interesting constructional forms of the arrangement are represented in FIGS. 23*a* and 23*b*. Here, the jet-disruptive surface is realized by means of thin structures. In FIG. 23*a*, the surface of the armoring 10 object of which is to protected carries a thin structure, which contains disruptive bodies 66 for an early jet disruption. Such type of structures; for example, can be constituted of relatively thin metallic plates, of fiberglass reinforced plastic materials or polymers, which are cast, deep drawn, stamped, punched or compressed. FIG. 23*b* illustrates a further surface profile 67, whereby there are provided disruptive bodies possessing different lengths and shapes. It is also possible to contemplate additionally introducing masses into the upper region of the disruptive bodies 66, 67 in order to improve upon the disruptive effect.

Figure 24:
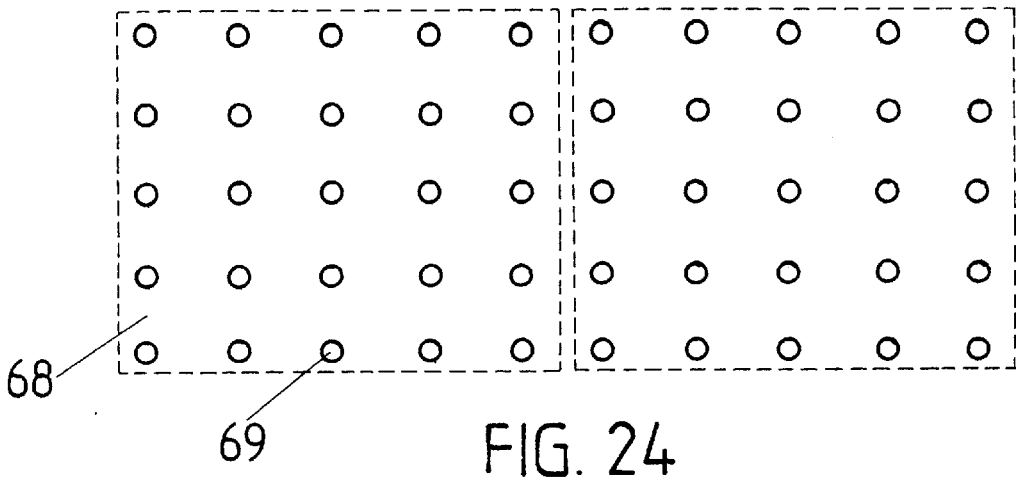
FIG. 24 illustrates modular elements for the receipt of disruptive bodies.

For the utilization there can be also of interest such installations which are modularly assembled and into which there can be inserted the desired disruptive bodies. FIG. 24 discloses two modules 68 with corresponding receivers 69. Hereby, this can relate to metallic support modules, as well as also those consisting of plastic, rubber, fiber-glass-reinforced plastic, or the like. Non-planar surfaces can be considered as being carried either through a modular configuration or through bendable support materials.

Figure 25A:
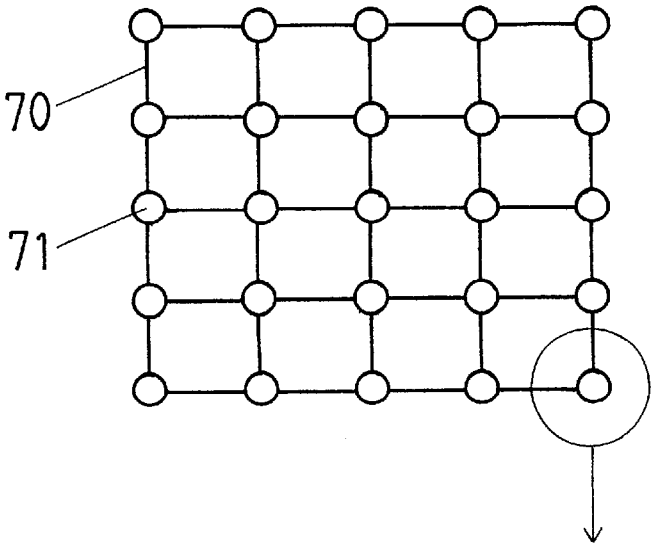
FIGS. 25*a* through 25*c* illustrate grids with knots for the receipt of disruptive bodies, and a knot in an enlarged view.
Figure 25B:
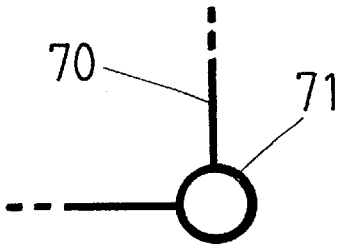
Figure 25C:
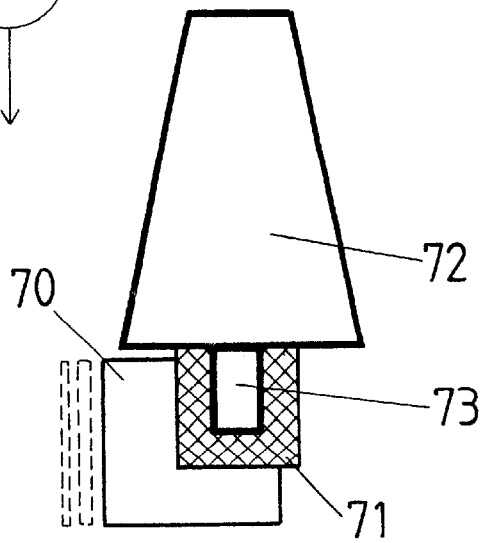

In FIGS. 25*a* through 25*c* there is further carried out the above-described principle with regard to a flexible configuration. Thereby this relates to a grid-like support structure 70, which preferably possesses in the knots or nodules therof receivers 71 for disruptive bodies. FIG. 25*b* illustrates a receiver 71 located in a kuat in plan, view shown in an enlarged representation. An inserted disruptive 72 is fastened, pursuant to FIG. 25*c*, by means of a projection or trunnion 73 in the receiver 71. That type of principle is adapted for the receipt of suitably shaped disruptive bodies in the most widely differing kinds of materials, or also for the exchanging of disruptive bodies; for example, against different types of threats.

It is also possible to contemplate that the examples of disruptive bodies or support layers for disruptive bodies which are represented in FIGS. 12, 23, 24 and 25 are constructed so thin or soft, that they possess outstanding damping properties. As a result, it is clearly contemplatable that also those with relatively high speeds or steeply descending speeds posing threats can be caught softly or resiliently, so that there is not at all produced any detonation of the bomblets.

A further advantage or relatively yieldable thicker disruptive bodies of support layers for disruptive bodies can consist of in that any threats prior to their detonation are permitted to enter relatively deeply. This is of advantage when the bomblet is equipped with a fragmentation casing, which concurrently accerates fragments with the formation of the hollow charge jet by means of the detonating explosive in a lateral direction. These will then be at least in an immersed part, absorbed by the disruptive bodies or support layer.

A particular advantage of the herein described arrangement for the disruption of hollow charge jets during their formation consists of in that, hereby in particular, there can be avoided weak points of protective structures. This is elucidated in the exemplary embodiments of disruptive bodies illustrated in the following described drawing figures.

Figure 26A:
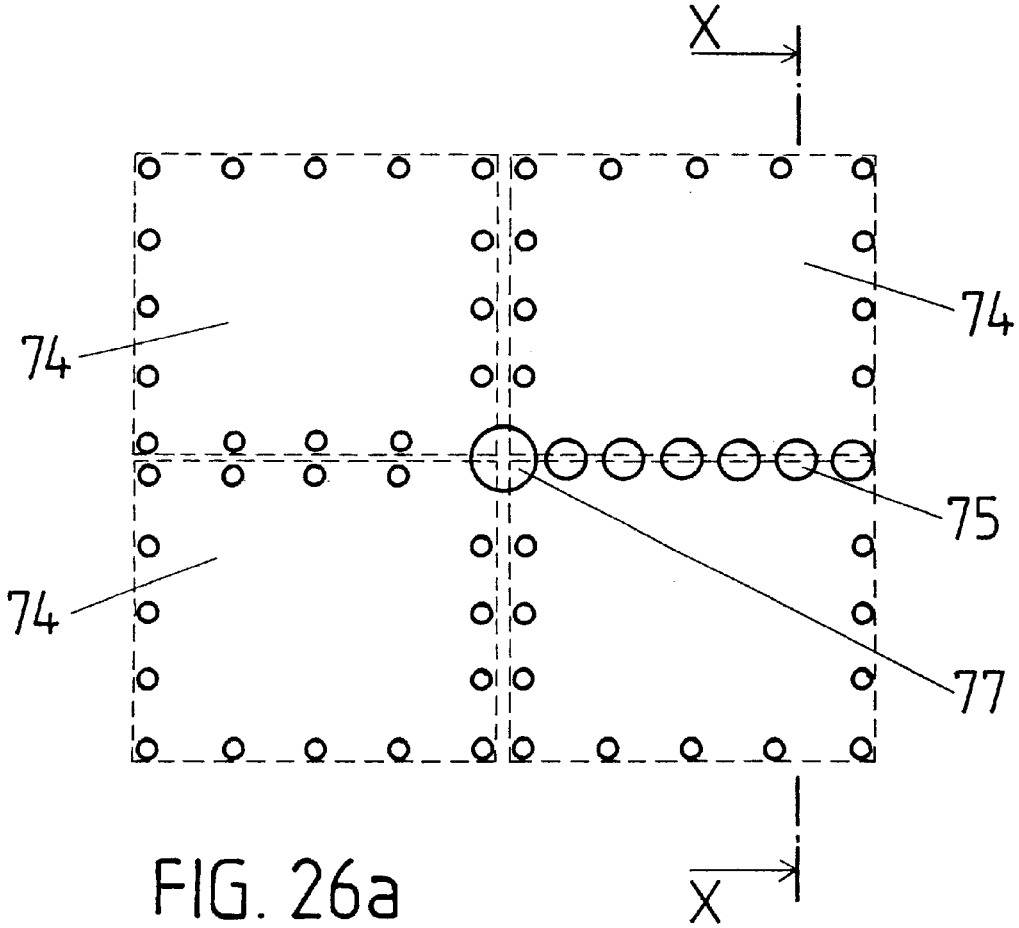
FIG. 26 illustrates adjacent modules with edge and joint protection through disruptive bodies.
Figure 26B:
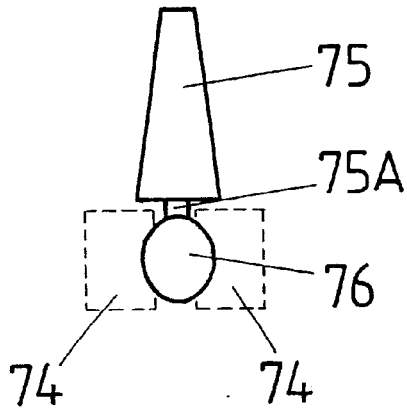

Thus, FIG. 26 illustrates four (4) protective modules 74. The disruptive bodies 75, 77 are here basically arranged in such a manner that there is reinforced a critical edge region or impact region between the protective modules 74. This can be effected in that the individual protective modules 74 possess disruptive bodies in their edge regions, or that disruptive bodies are directly integrated into the impact region. This is represented; for example, in FIG. 26 through the section X—X. This illustrates a bar 76 inserted between the protective modules 74, which contains applicable disruptive bodies 75, which are connected by means of connectors 75A with the bar 76. This bar 76 can also serve as a buffer element between the protective modules 74 or some other secondary functions (such as; for example, fixings). FIG. 26 also illustrates an example of the manner by which a central disruptive body 77 in the impact region of a plurality of protective modules 74 can attain a decisive increase in protective power.

Figure 27:
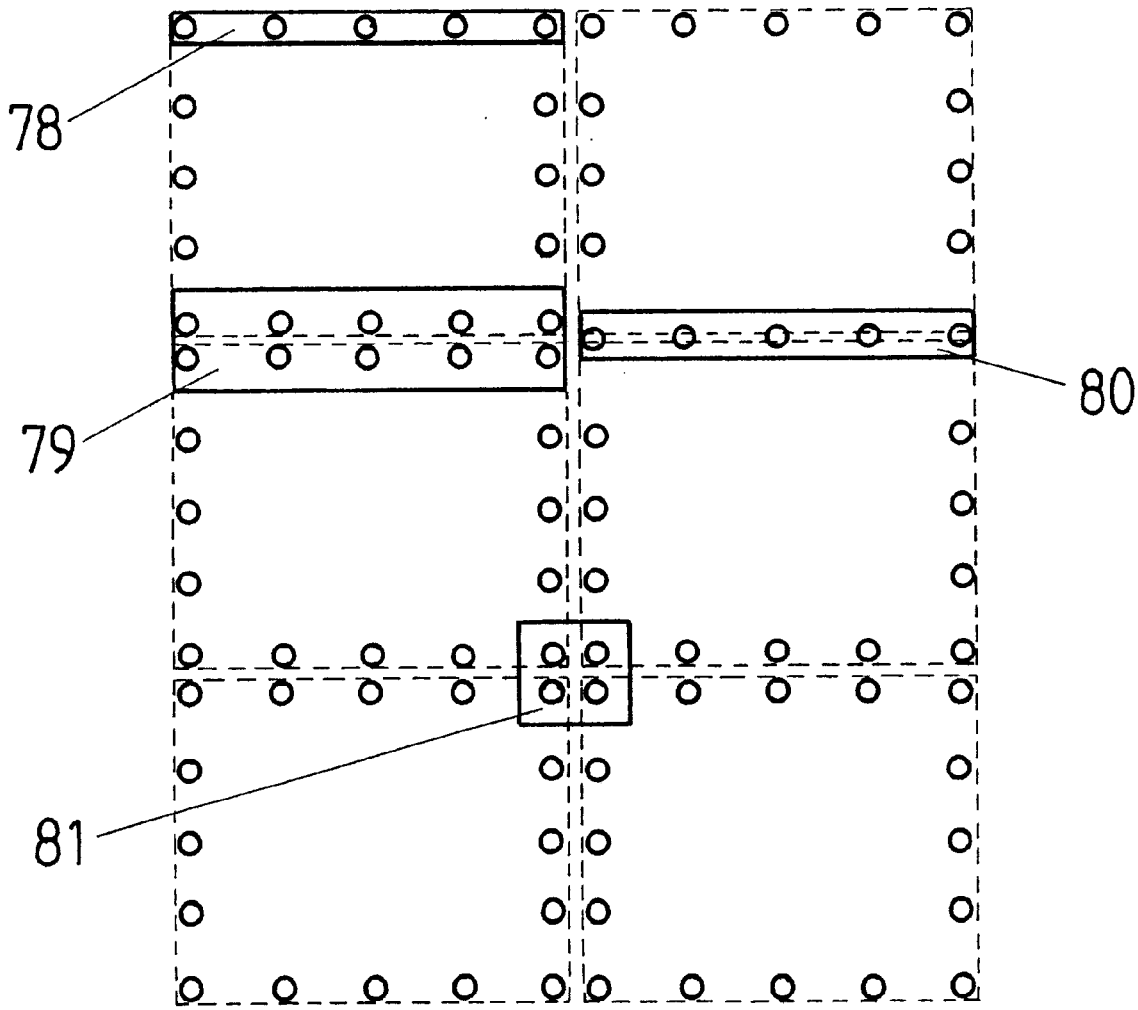
FIG. 27 illustrates adjacent modules having joint bridging elements with disruptive bodies.

In FIG. 27 there are illustrated further examples for avoiding weak locations of modular armorings by means of disruptive bodies. Thus, the edge regions of protective modeule 74 can be either reinforced through a one-sided edge bar carrying disruptive bodies or a lash 78, assembling two (2) modules and in the edge regions themselves covering bars or lashes 79, 80, or by covering the impact region of a plurality of protective module 74 through impact plates 81 carrying dissruptive bodies, thereby increasing the protection.

The edge bar or lash 78 is hereby especially provided for the outer region of the support layers to which no further support layer is connected. The bar or lash 79 is constructed relatively wide and possesses two adjacently arranged rows of disruptive bodies. Alternatively thereto, the bar or lash 80 is constructed so as to only possess a single row of disruptive bodies. The impact plate 81 layer is of a quadratic or round basic shape and provides the support for four (4) disruptive bodies. Basically,in accordance with need, the disruptive bodies can be constructed of any suitable geometric form, such as for example, spherically, cylindrically, conically or pyramid-shaped and designed differently in length or height. The disruptive bodies can be constituted of metallic materials, polymeric materials, glass or ceramic, fiber glass-reinforced plastics, of pressed members, cast members and/or of foamed materials.

On the basis of FIGS. 9 and 10, there is illustrated the instance in which the disruptive zones can be dynamically built up. FIGS. 28*a* through 31 illustrate hereby a series of technological types of solutions. Thus, in FIG. 28*a* in an armoring 82 there is integrated an arrangement for protection against shaped charges, whereby, upon need, by means of a bellows 84 and a carrier or support plate 85, there can be extended disruptive bodies 90 from a chamber 83. A closed covering 93 of the arrangement is here effected through an apertured plate 91, whose bores 92 are associated with the disruptive bodies 90. As an outer covering 93 there can serve a thin plate or foil which; for example, can be pierce through by the disruptive bodies 90. Such a covering 93 can also assume a specialized function with regard to the signature.

The bellows 84 together with the carrier plate 85 encloses a pressure chamber 86. When, for instance, by means of an element 87 which generates a gas, which is controlled through a conduit 88, there is released a working gas, then the disruptive bodies 90 are pushed out of the upper surface of that the protective structure. It is also possible the working gas is conducted directed through a bore 89 into the pressure chamber 86.

Figure 28A:
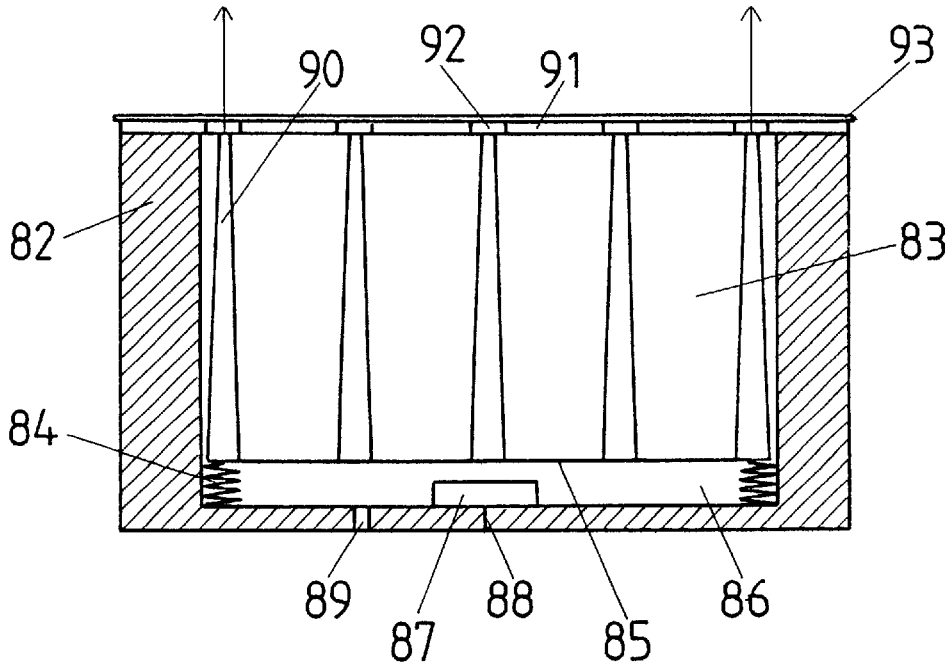
FIGS. 28*a* and 28*b* illustrate disruptive bodies which are extendable by means of a bellows, whereby the bellows remains in the armoring.
Figure 28B:
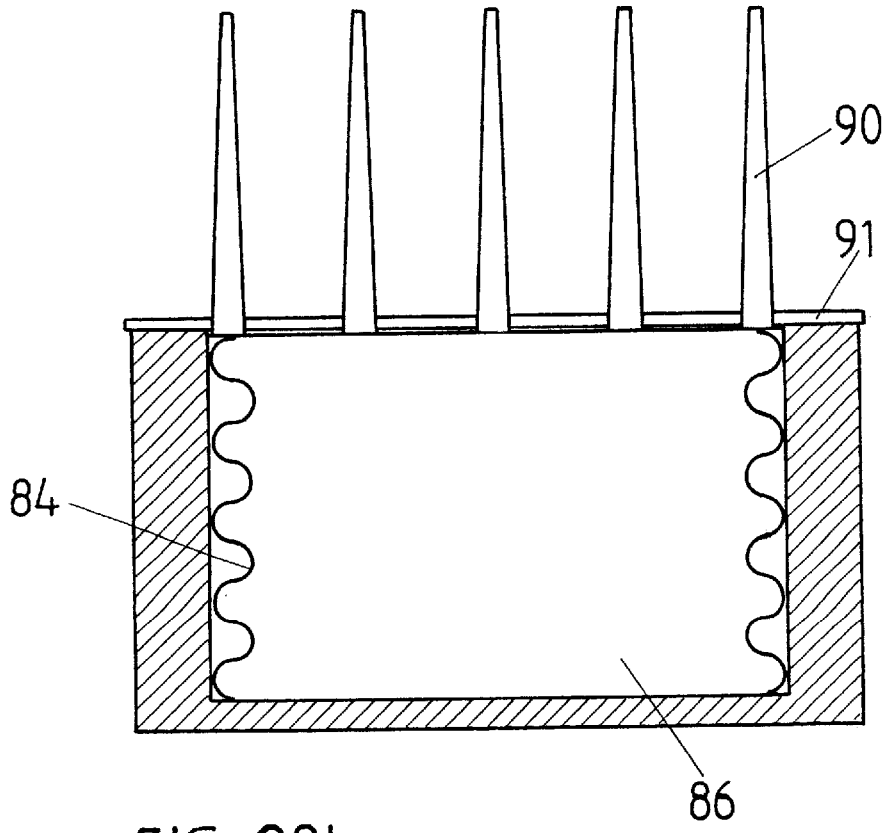
Figure 29A:
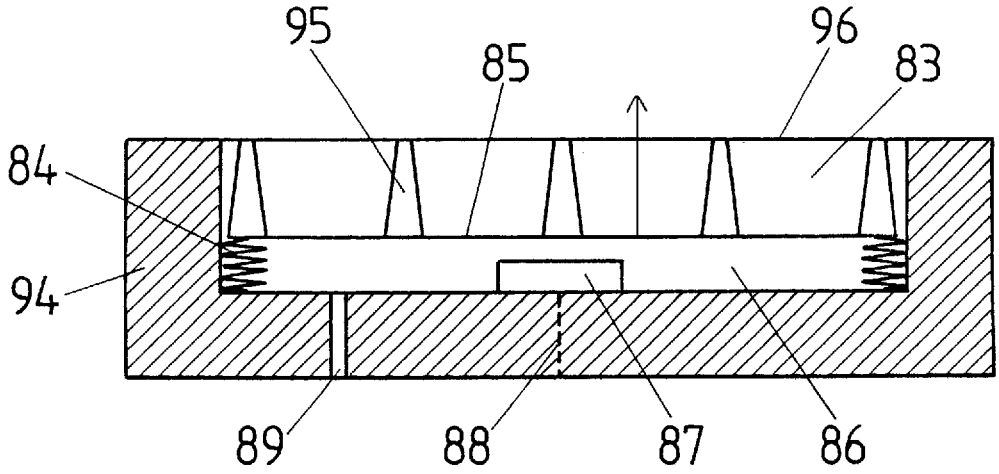
FIGS. 29*a* and 29*b* illustrate disruptive bodies which are extendable by means of the bellows, whereby the bellows projects above the armoring.
Figure 29B:
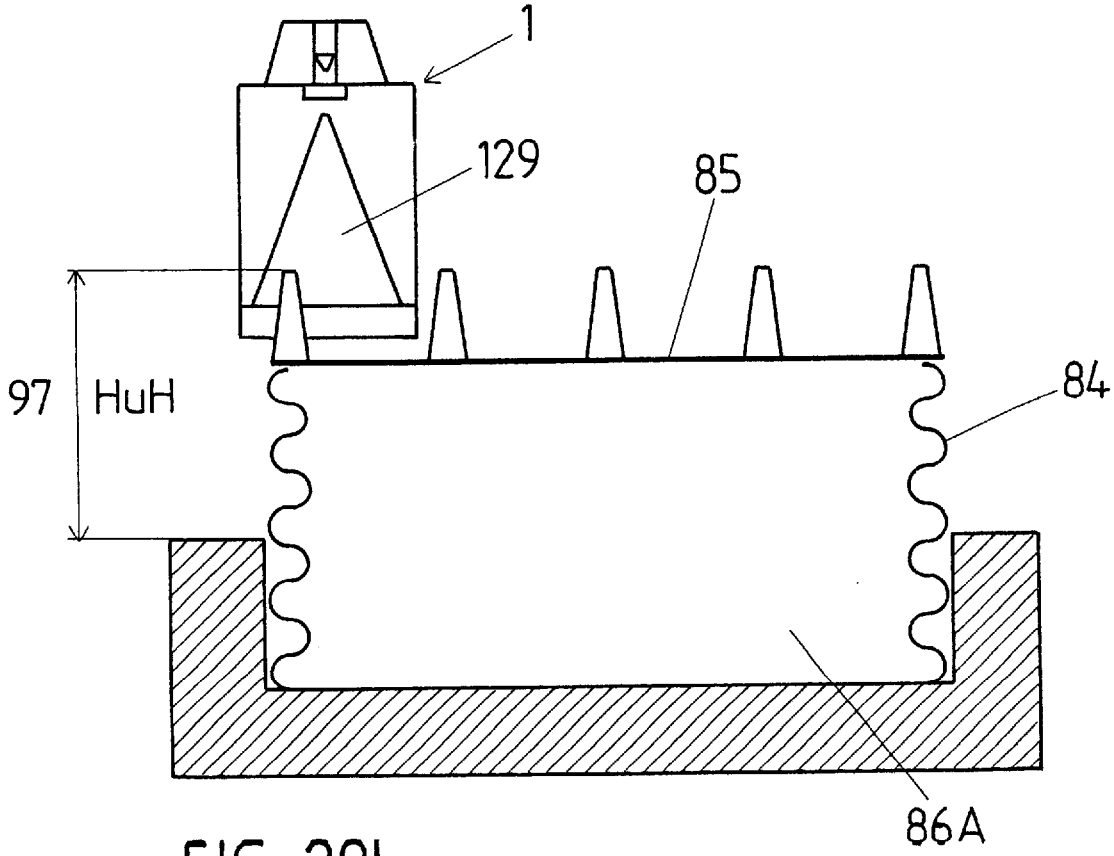

In the example illustrated in FIGS. 28*a* and 28*b*, the movement of the disruptive bodies 90 is limited by means of the plate 91. However, it is also possible to contemplate embodiments in which disruptive bodies can be pushed out relatively far from relatively flat protective arrangements by means of movable platforms. For this purpose, FIGS. 29*a* and 29*b* illustrate an exemplery embodiment. With consideration given to FIGS. 28*a* and 28*b*, there is again effected the outward extension of disruptive bodies 95 from a module 94 by means of a bellows 84. The module 84 is closed off by a layer 96. Upon need, by means of this arrangement there can be introduced into the pressure chamber 86 a working medium, such as; for example, a working gas, so that the volume 86A of the pressure chamber 86 is significantly increased and the bellows 84, as represented in FIG. 29*b*, is outwardly extended. Hereby, there can be achieved relatively large lifting heights HuH at 97.

Figure 30:
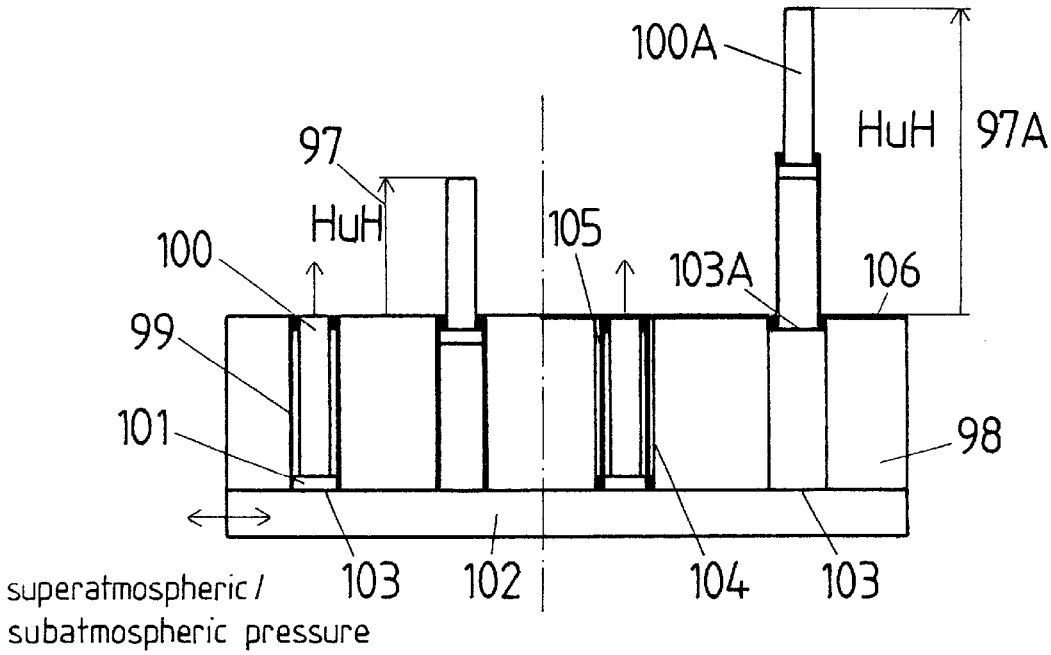
FIG. 30 illustrates telescopably configured disruptive bodies.

In FIG. 30 there is illustrated the instance in which individual disruptive bodies can be extended from a protective structure. At the left-hand side, by means of a superatmospheric pressure in the in feed line 102 and in the bore 103 there is moved a disruptive body 100 in a piston 99. The base piece 101 serves as a seal and lift limiter. The height of the disruptive body 100 thereby determines in a first instance, the reachable lifting height HuH of 97. It is also contemplatable that with that type of arrangement by means of superatmospheric pressure or subatmospheric pressure the disruptive body 100 can be outwardly moved or inwardly retracted. At the right-hand side in FIG. 3 there are extended telescopable disruptive bodies. Hereby, by means of a piston 104 there is moved a second piston 105, in which there is movable an end member 100A. The introduction of the working gas is carried out through the bores 103 and 103A. By means of this telescoping principle it is possible to achieve a relatively large lifting height HuH at 97A.

Figure 31:
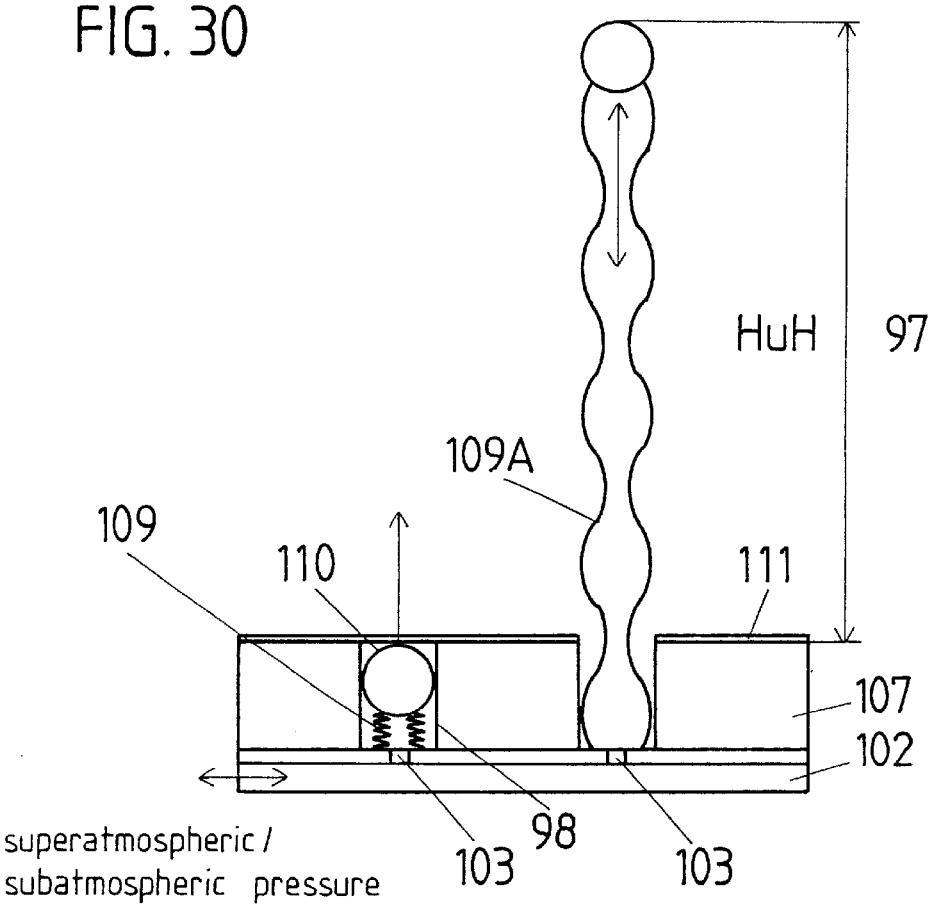
FIG. 31 illustrates disruptive bodies which are outwardly and again inwardly movable by means of a bellows.

FIG. 31 illustrates a technical construction for the outward ejection of individual disruptive bodies 110 from a protective structure 107, which is either eposed or covered by means of a layer 111. In accordance with the preceding two examples, and alternatively to FIG. 22, the outward displacement and the retraction of the disruptive bodies is effected through a working gas. A bellows at 109 is thereby represented in the retracted condition and at 109A in the outwardly extended condition.

Figures 32A, 32B:
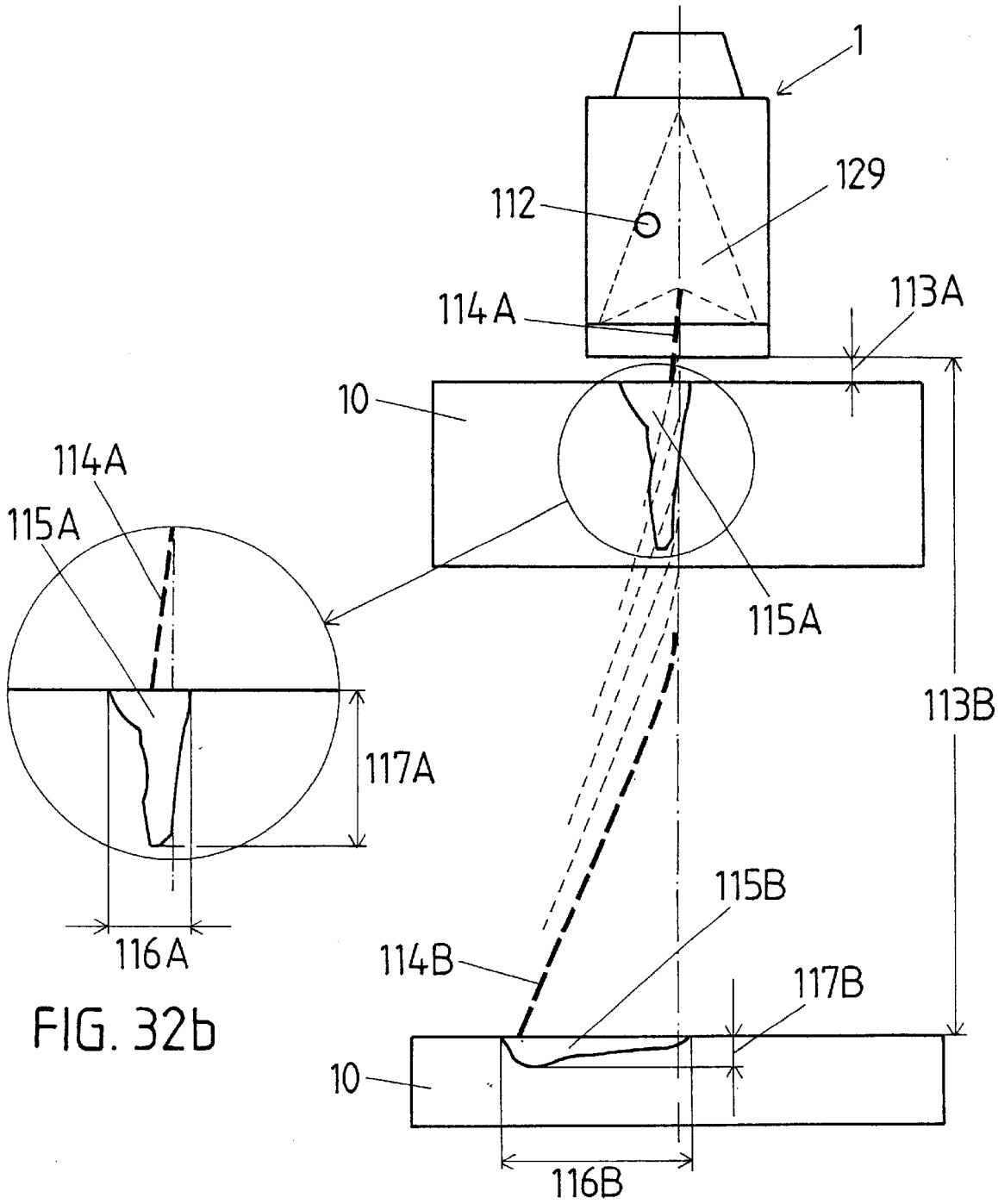
FIG. 32 illustrates the influence the disruptive distance from the surface of the object which is to be protected.

Quite generally, power of shaped charges, as previously mentioned is determined through the stand-off, in effect, the distance of the edge of the insert from the surface of the structure which is to be protected. Charges for initiating an attack from above, the so-called bomblets 1, distinguish themselves as a rule in that already at a small-stand off, they achieve the desired penetrating power. However, also their penetrating power grows upon an increase in the stand off. The herein proposed principle in employing the effect of disruption of the jet formation or the jet disruption while still in the region of the insert, is in a special manner adapted such that the final ballistic power of shaped charges also at larger stand-offs are significantly reduced. The cause for this is represented in FIG. 32. Considered is a relatively small stand-off 113A of the bomblet 1 to the surface of the armoring 10 of the object which is to be protected in comparison with a relatively larger distance 113B. It is assumed that the center of gravity 112 in the effectiveness of the disruptive body will disrupt the forming jet in such a manner that upon reaching of the somewhat proximate surface of the object which is to be protected, the jet already evidences a lateral deflection 114A. As previously mentioned, due to the deflection of the jet particles from the axis, the penetrating depth 117A is already extensively reduced at an increase in the crater diameter 116A.

When the surface of the armoring 10, at the same disruption, is at a considerably greater distance 113B, then the jet 114A is stretched and also directed inwardly at a greater lateral deflection 114B. This leads to a further significant reduction in the penetrating depth 117B at a concurrent increase in the crater diameter 116B. Inasmuch as in the two (2) illustrated examples, the displaced crater volumes 115A, 115B are comparable due to energetic reasons, there is obtained a physically final explanation for the reduction in the penetrating depth.

Figures 33A, 33B:
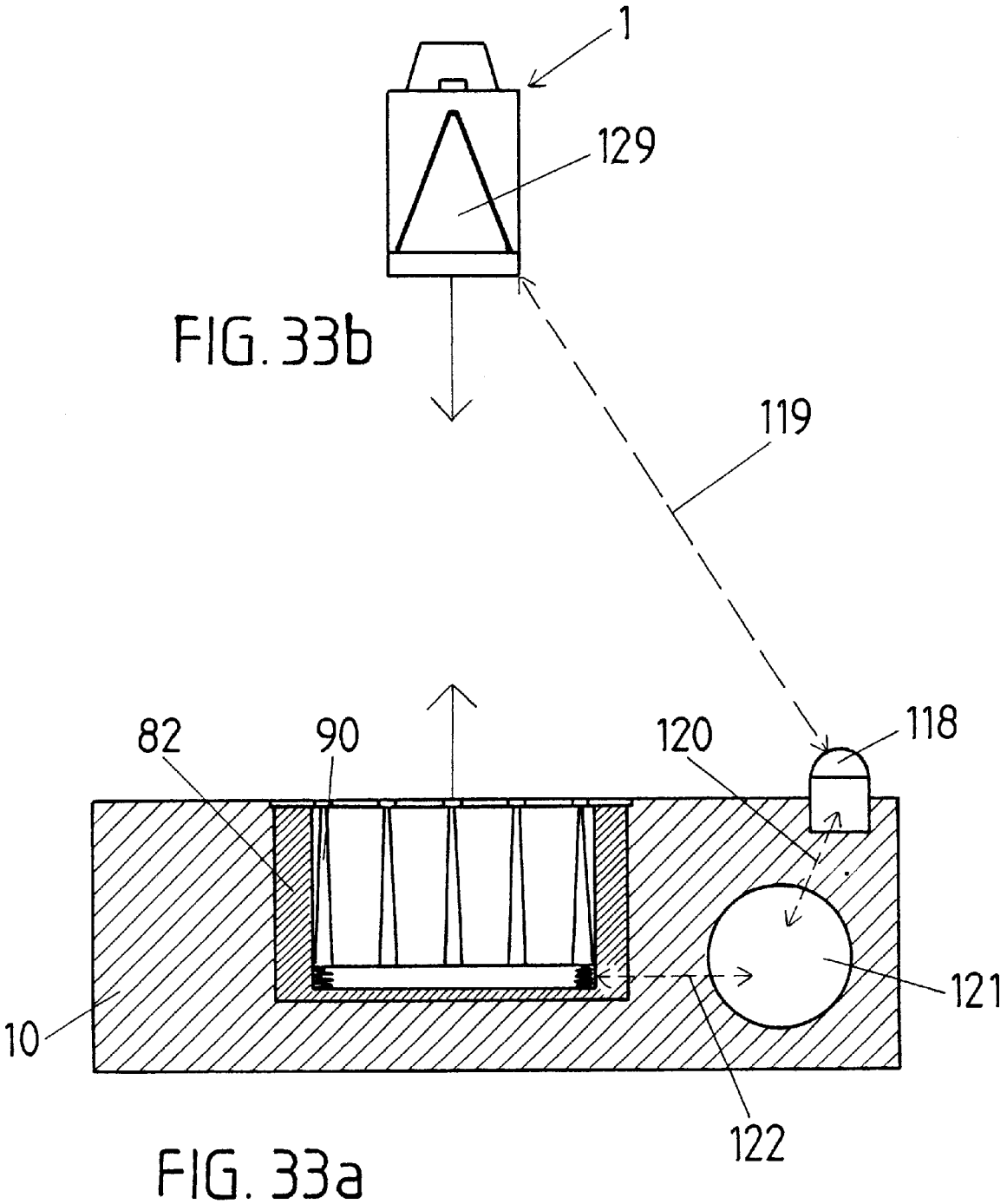
FIG. 33 illustrates disruptive bodies which are outwardly extendable by being controlled from a proximity sensor.

It is also quite possible to contemplate that disruptive bodies in accordance with the proposed solution can be extended or raised up from the surface of the armoring 10 by means of a sensor and corresponding installations upon sensing the approach of a threat. FIG. 33 illustrates an example for such a type of "active" solution. In this case, the approaching bomblet is detected by a proximity sensor 118, as is illustrated by means of a phantom double-headed arrow 119. This sensor 118 transmits on impulse through a line 120 to a control unit 121 which, in turn; for example, through a connection 122 is connected with a gas-operated arrangement or the pressure chamber 86 pursuant to FIGS. 28*a*, 28*b* or 29*a*, 29*b*. Naturally, the outward displacement can also be effected through other techniques. As examples there can serve electro-magnetic installations or also simple mechanical arrangements, such as springs.

Figure 34:
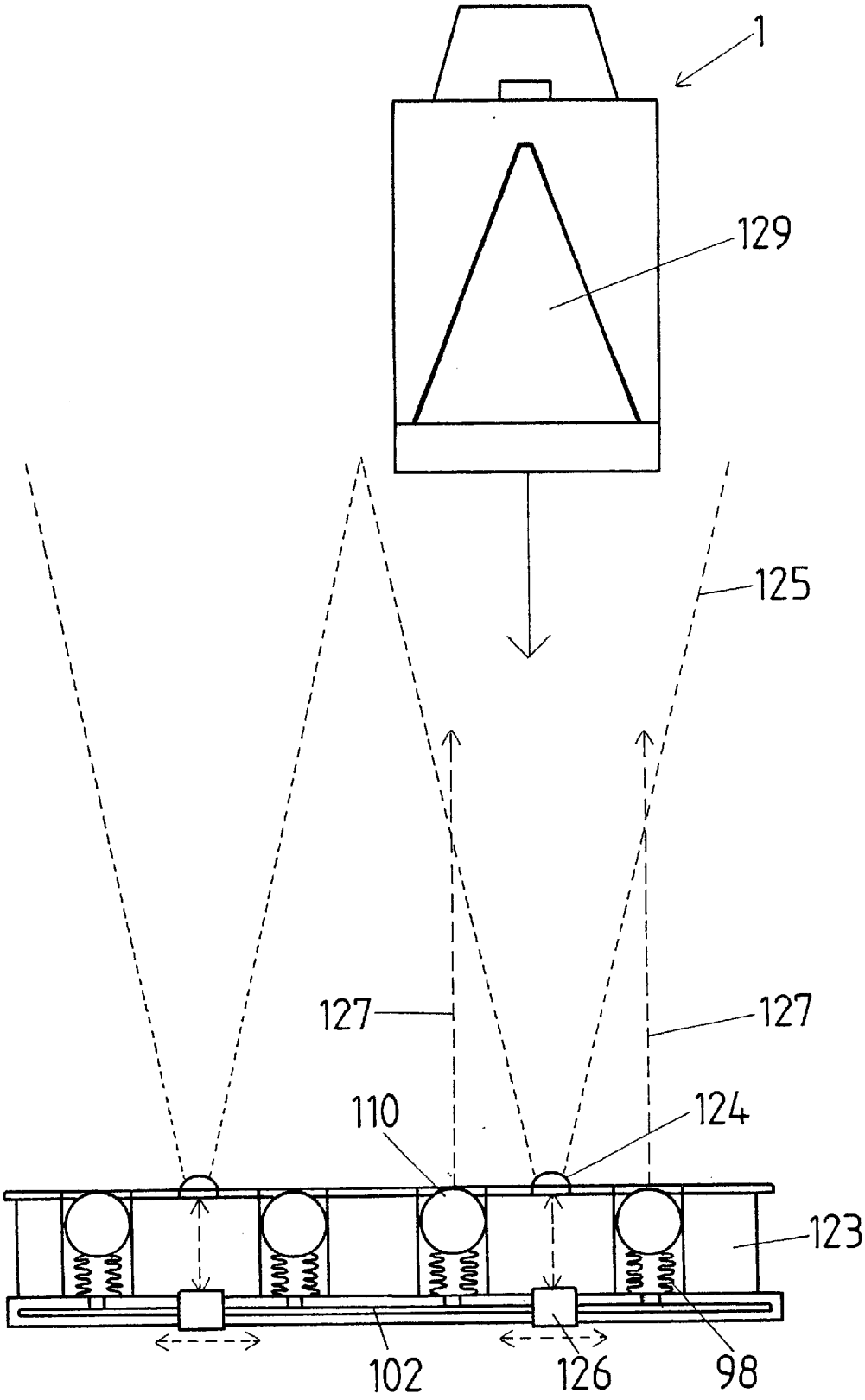
FIG. 34 illustrates an active arrangement for protection against approaching threats.

FIG. 34 illustrates a further example of an active protective arrangement for the ejection of disruptive bodies against approaching threats, such as hollow charges. In this exemplary embodiment, a target structure 123 contains individual acceleration chambers 98 which are provided with a covering 111, corresponding to the description of FIG. 31. A proximity sensor 124 is interlinked with an individual or with groups of defensive installations through the control element 126, and detects approaching threats, such as bomblets 1, in regions which are represented by 125. The outwardly displaced and, in this example, the disruptive bodies 110 which leave the target structure fly along a relatively short path, whose direction is identified by the arrow 127, opposite towards the bomblet 1 through the bores or the receiver of the acceleration chamber 98. In this manner, it is possible by means of a suitable combination of groups of disruptive bodies, to afford that at least always one disruptive body will penetrate into the approaching threat (bomblet) and decisively disrupt the formation of the jet.

At their ends facing away from the surface of the armoring 10 of the object which is to be protected, the disruptive bodies of all previously described exemplary embodiments can be constructed concavely, convexly, planar or pointy. Just as well, their side flanks can be constructed at right angles or at an acute angle linearly relative to the surface of the armoring 10. Similarly, it is also possible to impart a curved surface to the sides of the disruptive bodies.

In order to guarantee the most possibly efficient disruption of the jet, and to maintain the weight of the object which is designed to be protective as low as possible, there must be considered an optimum mass distribution during the configuring of the disruptive bodies. In principle, it is expedient for the jet disruption when the disruptive bodies are correlated essentially with the shape of the insert, which is mostly conically or in a trumpet shaped form. This signifies that the further the disruptive bodies penetrate or enter into the interior region of the insert 4, the less mass is required, especially in the end region of the disruptive bodies, for an effective disruption of the jet formation. In the region of the surface of the object which is to be protected there is required more mass for the disruption of the jet formation, so that essentially at a mass and effectiveness optimized disruptive body there is obtained a profile which is similar to the Ganssian normal distribution curve.

Pursuant to another herein not specifically represented embodiment of the protective arrangement, there can be made provision that the disruptive bodies are movably arranged in guide rails which facilitate a sliding of the disruptive bodies along the surface of the object which is to be protected. Accordingly, it is possible to effectively protect a large surface with only a few disruptive bodies. The arrangement of the disruptive bodies can similarly be controlled for movement along the surface of the object which is to be protected by a motion reporter or sensor arranged on the surface of the object.

The disruptive bodies can be fixedly connected with the surface of the armoring 10 of the object which is to be protected by means of adhesives, soldering, welding or press fitting.

Alternatively, there is also present the possibility to detachably connect the disruptive bodies with the surface of armoring 10 of the object of which to be protected by means of a screw connection or a plug connection. The disruptive bodies, in a particular embodiment, can consist of a combination of metallic, fiberglass-reinforced plastic materials, glass or ceramic, polymer films and/or foamed materials.

The wall thicknesses of metallic disruptive bodies can be lined in the magnitude of the wall thickness of the insert 4 at the disruptive location, whereby, however, also wall thicknesses for the disruptive bodies can be contemplated which deviate from the wall thickness of the insert 4. The average diameter of the disruptive body can be approximately two to five times that of the wall thicknesses of the insert 4 at the disruptive location.

For elongate disruptive bodies, for example, such as slender cylinders or springs among others, the diameter of the disruptive bodies can correlate in a particular configuration with the average wall thickness of the insert 4. When the disruptive bodies are formed of non-metallic materials, then the disruptive mass in the disruptive center of generally the mass can correspond with the mass which corresponds to the mass of the insert 4 at this particular location.

What is claimed is:

1. An arrangement for protection against attack by shaped charges and bomlets which approach or seat themselves on an armored object, characterized in that a surface of the armoring of the object which is to be protected has disruptive bodies associated therewith, the height, form and arrangement are dimensioned so that at least one of said disruptive bodies, for the disruption of the formation of a jet from the shaped charge, can selectively penetrate into an interior region of a hollow charge insert of the shaped charge and into a stand-off region of the shaped charge.

2. An arrangement according to claim 1, characterized in that the disruptive bodies are geometric bodies and are arranged and constructed in a manner so as to form a quasi-planar and/or accessible surface of the armoring.

3. An arrangement according to claim 1 or 2, characterized in that between the disruptive bodies and the surface of the armoring of the object which is to be protected there is located a connector which retains at least one of the disruptive bodies into a specified position.

4. An arrangement according to claim 1, characterized in that the disruptive bodies in relationship to an inner diameter of the shaped charge are so thin as to be able to penetrate into an upper region of the hollow charge insert.

5. An arrangement according to claim 1, characterized in that the disruptive bodies are entirely or partially brittle and/or rigidly constructed.

6. An arrangement according to claim 5, characterized in that the disruptive bodies are constituted partially or completely of metallic materials.

7. An arrangement according to claim 5, characterized in that the disruptive bodies are constituted entirely or partially of fiberglass-reinforced plastic materials.

8. An arrangement according to claim 5, characterized in that the disruptive bodies are constituted entirely or partially of glass or ceramic.

9. An arrangement according to claim 1, characterized in that the disruptive bodies are constituted entirely or partially of polymer materials.

10. An arrangement according to claim 1, characterized in that the disruptive bodies are constituted entirely or partially of pressed members.

11. An arrangement according to claim 1, characterized in that the disruptive bodies are constituted entirely or partially of foamed materials.

12. An arrangement according to claim 1, characterized in that the disruptive bodies are constituted of a combination of materials selected from the group consisting of metallic materials, fiberglass-reinforced plastic materials, glass ceramic, polymer materials, pressed members and foamed materials.

13. An arrangement according to claim 1, characterized in that the disruptive bodies are constructed entirely or partially hollow.

14. An arrangement according to claim 1, characterized in that the disruptive bodies are filled with a medium.

15. An arrangement according to claim 1, characterized that the disruptive bodies are solidly constructed.

16. An arrangement according to claim 1, characterized that the disruptive bodies are equipped with a tip and are variably dimensioned in diameter along their lengths.

17. An arrangement according to claim 1, characterized that the disruptive bodies are fixedly connected with the surface of the armoring of the object which is to be protected.

18. An arrangement according to claim 17, characterized that the disruptive bodies are selectively connected with the surface of the armoring of the object which is to be protected through the intermediary of adhesives, soldering, welding or press fitting.

19. An arrangement according to claim 1, characterized in that the disruptive bodies are detachably connected to the surface of the armoring of the object which is to be protected.

20. An arrangement according to claim 19, characterized in that the disruptive bodies are screwed to with the surface of the armoring of the object which is to be protected or inserted therein by a plug connection.

21. An arrangement according one claim to claim 1, characterized that the disruptive bodies are movably supported on the surface of the armoring of the object which is to be protected.

22. An arrangement according to claim 1, characterized in that the disruptive bodies are arranged relative to the surface of the armoring of the object which is to be protected so as to project sutuerdly therefrom only upon need in case of a threat.

23. An arrangement according to claim 1, characterized in that the disruptive bodies are fixed through embedding thereof into a comparatively soft matrix which is arranged on the surface of the armoring of the object which is to be protected.

24. An arrangement according to claim 23, characterized in that the matrix contains the disruptive bodies in either a uniform or irregular distribution.

25. An arrangement according to claim 1, characterized in that the disruptive bodies are connected with a modularly assembled layer arranged on the surface of the armoring of the object which is to be protected, whereby the individual modules of the layer are interconnected with each other by connecting elements which facilitate a certain movability of the connection.

26. An arrangement according to claim 25, characterized in that the layer is constructed as an apertured plate or strips in which there are fastened the disruptive bodies.

27. An arrangement according to claim 25, characterized in that the disruptive bodies are mounted on the protective modular layer through the intermediary of a fastener element or a fastening layer.

28. An arrangement according to claim 27, characterized in that the fastening layer comprises an adhesive foil.

29. An arrangement according to claim 1, characterized by a layer formed of disruptive bodies, which is bendably constructed and correlated with the surface of the armoring of the object which is to be protected.

30. An arrangement according to claim 1, characterized in that the disruptive bodies, are constructed so as to deform and/or penetrate the hollow charge insert.

31. An arrangement according to claim 1, characterized in that the disruptive bodies are constructed to be able to penetrate a covering which is arranged infront of the interior region of the hollow charge insert.

32. An arrangement according to claim 1, characterized through the provision of disruptive body layers which are equipped with a covering.

33. An arrangement according to claim 1, characterized in that the disruptive bodies are outwardly displaceable from a layer surrounding the disruptive bodies.

34. An arrangement according to claim 33, characterized in that the layer contains suitably distributed disruptive bodies.

35. An arrangement according to claim 1, characterized by a layer surrounding the disruptive bodies which deflects in front of the shaped charge and thereby releases the disruptive bodies.

36. An arrangement according to claim 33, characterized in that the layer carries individual said disruptive bodies.

37. An arrangement according to claim 1, characterized in that the disruptive bodies are supported swingebly, resiliently or bendably in a turning device.

38. An arrangement according to claim 1, characterized in that an armoring which follows the disruptive bodies is correlated with a disruptive zone formed by one of the disruptive bodies and forms a connection therewith.

39. An arrangement according to claim 1, characterized in that the disruptive bodies are variable in their lengths.

40. An arrangement according to claim 39, characterized that the disruptive bodies which are variable in their lengths are mounted in chambers and the chambers are equipped with a movable covering.

41. An arrangement according to claim 1, characterized that the disruptive bodies are integrally formed with a layer.

42. An arrangement according to claim 1, characterized that a surface layer of the armoring is formed by a rigid or bendable matting with receivers for the disruptive bodies.

43. An arrangement according to claim 1, characterized that the disruptive bodies are at least partially formed as springs which possess at their ends distant from the surface of the armoring an additional disruptive mass.

44. An arrangement according to claim 1, characterized in that first upon the striking of the shaped charge formed on a relatively soft deformable target material or a layer which is located on the surface of the armoring of the object which is to be protected, in which the target material of the one part of the layer is pushed into the interior region of the hollow charge insert.

45. An arrangement according to claim 1, characterized at least a part of the disruptive bodies is formed as a rubber-like element which is bellows-like foldable.

46. An arrangement according to claim 1, characterized that the disruptive bodies are fixed on a support plate by means of bores and surrounded by a casing layer.

47. An arrangement according to claim 1, characterized in that on the surface of the armoring there is arranged a detection device.

48. An arrangement according to claim 47, characterized in that the detection device activates a protective module prosessing disruptive bodies.

49. An arrangement according to claim 48, characterized in that disruptive bodies are accelerated from one or more said protective modules against a threat from said shaped charges.

* * * * *